US010330069B2

(12) United States Patent
Harris et al.

(10) Patent No.: US 10,330,069 B2
(45) **Date of Patent: *Jun. 25, 2019**

(54) SYSTEM CONTROL STRATEGY AND METHODS FOR MULTI-PHYSICS FLUID ATOMIZING

(71) Applicant: Enginetics, LLC, Fernandina, FL (US)

(72) Inventors: Roderick James Harris, Northville, MI (US); Joseph Lull, South Haven, MI (US)

(73) Assignee: ENGINETICS, LLC, Miami Beach, FL (US)

( * ) Notice: Subject to any disclaimer, the term of this patent is extended or adjusted under 35 U.S.C. 154(b) by 10 days.

This patent is subject to a terminal disclaimer.

(21) Appl. No.: 15/824,882

(22) Filed: Nov. 28, 2017

(65) Prior Publication Data

US 2018/0080424 A1 Mar. 22, 2018

Related U.S. Application Data

(63) Continuation of application No. 14/962,306, filed on Dec. 8, 2015, now Pat. No. 9,828,962, which is a (Continued)

(51) Int. Cl.
*F02B 21/00* (2006.01)
*F02B 33/00* (2006.01)
(Continued)

(52) U.S. Cl.
CPC ..... *F02M 67/02* (2013.01); *F02B 21/00* (2013.01); *F02B 33/00* (2013.01); *F02B 33/446* (2013.01);
(Continued)

(58) Field of Classification Search
CPC ..... F02M 67/02; F02M 67/04; F02B 63/06; F02B 33/00; F02B 39/10; F02B 21/00; F02B 33/446; F02B 67/10
(Continued)

(56) References Cited

U.S. PATENT DOCUMENTS 1,871,115 A 8/1932 Cowardin et al.
1,928,754 A 10/1933 French
(Continued)

FOREIGN PATENT DOCUMENTS

WO 2008067623 A1 6/2008
WO 2011041890 A1 4/2011

OTHER PUBLICATIONS

PCT International Search Report for International Application No. PCT/US14/32878, dated Apr. 1, 2015.
(Continued)

*Primary Examiner* — J. Todd Newton
(74) *Attorney, Agent, or Firm* — Holland & Hart LLP

(57) ABSTRACT

A method of controlling fuel delivery to an engine includes providing a fluid atomizer, a mechanically driven air compressor, a start up air source, and an air valve coupled between the mechanically driven air compressor and the start up air source, charging the start up air source, delivering compressed air from the start up air source to the fluid atomizer, providing an initial air/fluid mixture with the fluid atomizer, and operating the air valve to direct compressed air from the mechanically driven air compressor to the fluid atomizer.

20 Claims, 20 Drawing Sheets

Related U.S. Application Data continuation of application No. 13/857,797, filed on Apr. 5, 2013, now Pat. No. 9,206,737.

(51) Int. Cl.

| | |
|---|---|
| ***F02B 33/44*** | (2006.01) |
| ***F02B 39/10*** | (2006.01) |
| ***F02B 63/06*** | (2006.01) |
| ***F02B 67/10*** | (2006.01) |
| ***F02M 67/02*** | (2006.01) |
| ***F02M 67/04*** | (2006.01) |

(52) U.S. Cl.

CPC ..... *F02B 39/10* (2013.01); *F02B 63/06* (2013.01); *F02B 67/10* (2013.01); *F02M 67/04* (2013.01)

(58) Field of Classification Search

USPC .... 123/531–534, 298, 536, 559.1, 561, 590, 123/592

See application file for complete search history.

(56) References Cited

U.S. PATENT DOCUMENTS

| | | | |
|---|---|---|---|
| 2,693,311 | A | 11/1954 | Kratzer |
| 2,697,007 | A | 12/1954 | Rudolf |
| 2,867,375 | A | 1/1959 | Petersen |
| 2,950,707 | A | 8/1960 | Butler |
| 3,282,573 | A | 11/1966 | Phelps |
| 3,907,207 | A | 9/1975 | O'Brien |
| 3,929,290 | A | 12/1975 | Tallarovic |
| 3,963,379 | A | 6/1976 | Ueno |
| 4,157,084 | A | 6/1979 | Wallis |
| 4,465,050 | A | 8/1984 | Igashira et al. |
| 4,771,754 | A | 9/1988 | Reinke |
| 4,828,181 | A | 5/1989 | Singels-Craenen |
| 4,899,714 | A | 2/1990 | Schechter et al. |
| 4,982,716 | A | 1/1991 | Takeda et al. |
| 5,035,358 | A | 7/1991 | Katsuno et al. |
| 5,156,133 | A | 10/1992 | Sugimoto et al. |
| 5,205,120 | A | 4/1993 | Oblander et al. |
| 5,207,204 | A | 5/1993 | Kawachi et al. |
| 5,255,658 | A | 10/1993 | Hoffer et al. |
| 5,301,879 | A | 4/1994 | Takeda et al. |
| 5,360,166 | A | 11/1994 | Nogi et al. |
| 5,404,717 | A | 4/1995 | Nogi et al. |
| 5,503,130 | A | 4/1996 | Pomeisl |
| 5,526,796 | A | 6/1996 | Thring et al. |
| 5,997,259 | A | 12/1999 | Marshall et al. |
| 6,039,029 | A | 3/2000 | Nagasaka et al. |
| 6,065,691 | A | 5/2000 | West |
| 6,161,527 | A | 12/2000 | Ruman |
| 6,205,983 | B1 | 3/2001 | Egizi |
| 6,561,167 | B2 | 5/2003 | Berndt |
| 6,752,131 | B2 | 6/2004 | Poola et al. |
| 6,925,979 | B1 | 8/2005 | Seitz |
| 6,955,161 | B2 | 10/2005 | Suzuki et al. |
| 7,036,753 | B2 | 5/2006 | Huffman |
| 7,104,477 | B2 | 9/2006 | Kilgore et al. |
| 7,950,370 | B2 | 5/2011 | Lucas et al. |
| 8,479,514 | B2 | 7/2013 | Mayr |
| 8,672,234 | B2 * | 3/2014 | Amaya ..... F02M 35/10085 239/5 |
| 9,032,938 | B2 * | 5/2015 | Harris ..... F02D 41/0025 123/532 |
| 9,206,737 | B2 * | 12/2015 | Harris ..... F02B 67/10 |
| 9,261,049 | B2 * | 2/2016 | Huettner ..... F02M 43/04 |
| 2003/0094162 | A1 | 5/2003 | Baldwin |
| 2011/0284652 | A1 | 11/2011 | Amaya et al. |
| 2014/0299671 | A1 | 10/2014 | Lull et al. |

OTHER PUBLICATIONS

Wall, John, Microprocessor Clutch Controller and Electro Rheological Clutch, Dec. 2, 1988, (5 pp.).

Bullough, W.A., et al., The Electro-Rheological Clutch: Design Performance Characteristics and Operation, Proceedings of the Institution of Mechanical Engineers, Part I: Journal of Systems and Control Engineering, May 1993, 207:87-95, (9 pp.).

Johnson, A.R., et al., Fluid Durability in a High Speed Electro-Rheological Clutch, Journal of Intelligent Material Systems and Structures, vol. 4 (4): 527-532 Sage—Oct. 1, 1993 (6 pp.).

* cited by examiner

SYSTEM CONTROL STRATEGY AND METHODS FOR MULTI-PHYSICS FLUID ATOMIZING

CROSS-REFERENCE TO RELATED APPLICATIONS

This application is a continuation of application Ser. No. 14/962,306, filed 8 Dec. 2015, and entitled SYSTEM CONTROL STRATEGY AND METHODS FOR MULTI-PHYSICS FLUID ATOMIZING, now U.S. Pat. No. 9,828,962, issued 28 Nov. 2017, which is a continuation of application Ser. No. 13/857,797, filed 5 Apr. 2013, and entitled SYSTEM CONTROL STRATEGY AND METHODS FOR MULTI-PHYSICS FUEL ATOMIZER, now U.S. Pat. No. 9,206,737, issued 8 Dec. 2015, the disclosures of which are incorporated herein, in their entireties, by this reference.

TECHNICAL FIELD

The present disclosure is directed to fuel systems, and more particularly directed to control systems and related control strategies for fuel delivery systems.

BACKGROUND

Many types of devices have been developed over the years for the purpose of converting liquids into aerosols or fine droplets readily converted into a gas-phase. Many such devices have been developed, for example, to prepare fuel for use in internal combustion engines. To optimize fuel oxidation within an engine's combustion chamber, the fuel must be vaporized, homogenized with air, and in a chemically-stoichiometric gas-phase mixture. Ideal fuel atomization and vaporization enables more complete combustion and consequent lower engine out pollution.

More specifically, relative to internal combustion engines, stoichiometry is a condition where the amount of oxygen required to completely burn a given amount of fuel is supplied in a homogeneous mixture resulting in optimally correct combustion with no residues remaining from incomplete or inefficient oxidation. Ideally, the fuel should be completely vaporized, intermixed with air, and homogenized prior to ignition for proper oxidation. Non-vaporized fuel droplets do not ignite or combust completely in conventional internal and external combustion engines, which degrades fuel efficiency and increases engine out pollution.

Attempts to reduce or control emission byproducts by adjusting temperature and pressure typically affect the $NO_x$ byproduct. To meet emission standards, these residues must be dealt with, typically requiring after treatment in a catalytic converter or a scrubber. Such treatment of these residues results in additional fuel costs to operate the catalytic converter or scrubber and may require additional component costs as well as packaging and mass implications. Accordingly, any reduction in engine out residuals resulting from incomplete combustion would be economically and environmentally beneficial.

An engine running a closed loop in which $\lambda=1$ (e.g., when $\lambda$ equals the ratio of air/fuel ratio (AFR) divided by the stoichiometric air/fuel ratio ($AFR_{stoich}$) is targeted will typically be operating at or near stoichiometery. If the fuel is not completely vaporized, the engine management system (EMS) will add extra fuel to ensure that stoichiometery is reached as the oxygen sensor is monitoring excess oxygen in the exhaust. A reduction in efficiency caused by fuel not being completely vaporized results from extra fuel being added to ensure stoichiometery is achieved. Fuel energy is wasted and unnecessary pollution is created when the fuel is not completely vaporized. Thus, by further breaking down and more completely vaporizing the fuel-air mixture, better fuel efficiency may be available.

Many attempts have been made to alleviate the above-described problems with respect to fuel vaporization and incomplete fuel combustion. In automobile engines, for example, inlet port or direct fuel injection systems have almost universally replaced carburetion for fuel delivery. Fuel injectors spray fuel directly into the inlet port or cylinder of the engine and are controlled electronically. Injectors facilitate more precise metering and control of the amount of fuel delivered to each cylinder independently relative to carburetion. This reduces or eliminates charge transport time facilitating optimal transient operation. Nevertheless, the fuel droplet size of a fuel injector spray is not optimal and there is little time for the fuel to mix with air prior to ignition.

Other prior systems, such as heated injectors and heated fuel rails have also been developed in attempts to remedy the problems related to fuel vaporization and incomplete fuel combustion.

Most fuel delivery systems require a source of air as part of delivering and/or preparing the fuel for delivery to a combustion chamber. A number of challenges exist in providing the source of air under proper conditions.

SUMMARY

The principles described herein may address some of the above-described deficiencies and others. Specifically, some of the principles described herein relate to liquid processor apparatuses and methods.

One aspect provides a method of controlling fuel delivery to an engine. The method includes providing a fuel atomizer, a mechanically driven air compressor, a start up air source, and an air valve coupled between the mechanically driven air compressor and the start up air source, charging the start up air source, delivering compressed air from the start up air source to the fuel atomizer, starting the engine using an air/fuel mixture provided by the fuel atomizer, and operating the air valve to direct compressed air from the mechanically driven air compressor to the fuel atomizer after the engine starts.

The start up air source may include an electrically driven air compressor. The start up air source may include an accumulator, and charging the start up air source includes delivering compressed air from one of a cylinder of the engine and an electrically driven air compressor to the accumulator. The start up air source may include a one-way valve and an accumulator, and charging the start up air source includes controlling air flow from a cylinder of the engine to the accumulator. The method may include providing a valve into the cylinder and determining an engine position and cycle before opening the valve. The method may include determining a pressure of the accumulator before delivering compressed air from the start up air source to the fuel atomizer. The start up air source may include an accumulator, and charging the start up air source may include delivering compressed air from the electrically driven air compressor to the accumulator. The method may include operating the mechanically driven air compressor to generate compressed air after starting the engine. If the mechanically driven air compressor generates an insufficient amount of pressurized air, the method may include delivering compressed air from the start up air source to the fuel atomizer to maintain the engine running.

A further aspect of the present disclosure relates to a method of controlling air flow to a fuel atomizer. The method includes providing a fuel atomizer, a mechanically driven air compressor, and a scavenger valve, the scavenger valve being coupled in flow communication with a cylinder of an engine. The method also includes opening the scavenger valve to collect compressed air, delivering the compressed air from the scavenger valve to the fuel atomizer to create an air/fuel mixture used to start the engine, and delivering compressed air from the mechanically driven air compressor to the fuel atomizer after the engine is running.

The method may include providing an air control valve coupled between the mechanically driven air compressor, the scavenger valve, and the fuel atomizer, and operating the air control valve to direct compressed air from the mechanically driven air compressor or the scavenger valve to the fuel atomizer depending on whether the engine is running. The method may include an accumulator coupled in flow communication between the scavenger valve and the fuel atomizer, and providing a one-way valve between the accumulator and the scavenger valve to prevent backflow of compressed air into the cylinder. The method may include opening the scavenger valve at points between bottom dead center (BDC) and top dead center (TDC) on a compression stroke of the engine. The method may include providing an accumulator coupled in flow communication between the mechanically driven air compressor and the fuel atomizer, and regulating pressure of the compressed air delivered to the fuel atomizer using the accumulator.

A further aspect relates to a method of starting an internal combustion engine. The method includes providing a fuel delivery system and a compressed air source, wherein the compressed air source operates independent of the engine running. The method also includes determining if the engine is running, if the engine is not running, providing a flow of compressed air from the compressed air source to the fuel delivery system, creating a fuel/air mixture with the fuel delivery system, and delivering the fuel/air mixture to a cylinder of the engine to start the engine.

The compressed air source may include an accumulator and an air compressor, and the method may include operating the air compressor to collect a charge of compressed air in the accumulator. The compressed air source may include an accumulator and a scavenger valve coupled to a cylinder of the engine, the method may further include operating the scavenger valve to collect compressed air from the cylinder when turning over the engine and before starting the engine, and delivering the compressed air to the accumulator.

The compressed air source may include first and second compressed air sources, the first compressed air source operating before the engine starts and the second compressed air source being powered by the engine after the engine starts. The first compressed air source may include one of an electrically driven compressor and a cylinder scavenger valve, and the second compressed air source comprises one of an mechanically driven compressor and an electrically driven compressor. The method may include providing a controller and a plurality of sensors, wherein the controller initiates delivery of the fuel/air mixture to the engine after a threshold air pressure is available from the compressed air source.

BRIEF DESCRIPTION OF THE DRAWINGS

The accompanying drawings illustrate certain embodiments discussed below and are a part of the specification.

Throughout the drawings, identical reference characters and descriptions indicate similar, but not necessarily identical elements.

DETAILED DESCRIPTION

Figure 1:
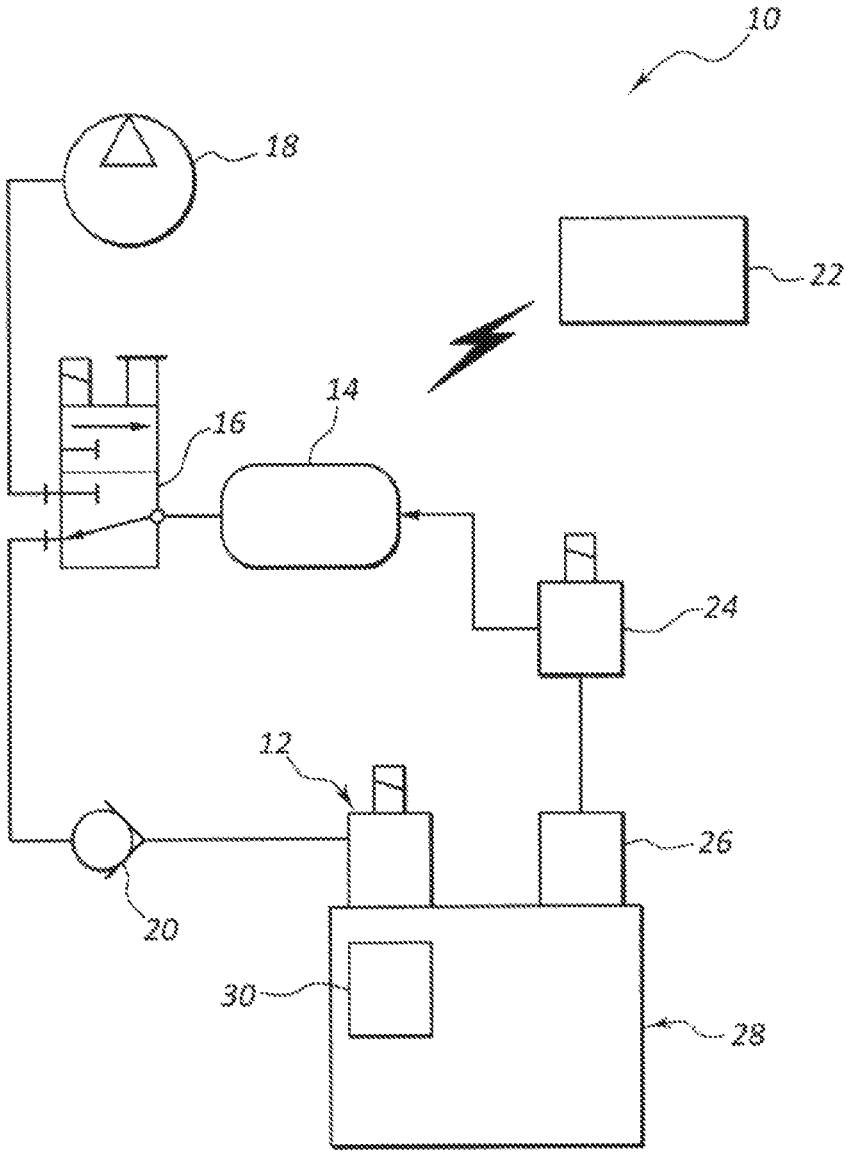
FIG. 1 is a schematic diagram showing an example air charging system in accordance with the present disclosure.

Illustrative embodiments and aspects are described below. It will, of course, be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present disclosure is directed to fuel preparation systems and methods, and related systems and methods for creating charged air that is used for the fuel preparation system. One type of fuel preparation system has a dual fluids input, wherein one of the fluids is a gas (e.g., air or an inert gas) and the other fluid is a liquid (e.g., liquid fuel such as gasoline). The term air as used herein may be replaced with the term gas, inert gas or oxidant. A supply of the gas under pressure (e.g., compressed gas, air or oxidant) is needed to commence operation of the fuel preparation system in order to deliver a prepared fuel charge to the engine for starting the engine. Once the engine is running, a mechanically or electrically driven compressor may assume the task of providing a source of the compressed gas to the fuel preparation system. The supply of compressed gas prior to starting the engine may be provided using, for example, a charge accumulator tank, a converter, a reformer, or other charge supply device.

An example air charging system in accordance with the present disclosure provides compressed gas using an electric air compressor or via externally charging an accumulator with compressed air. Alternatively, an in-cylinder charging system, which is described in detail below, utilizes an electrically or mechanically actuated poppet valve in the cylinder head to scavenge pressurized air during the engine's compression stroke prior to starting. Once the engine is running, a mechanically or electrically driven compressor may assume the task of providing the compressed air.

An example air charging system in accordance with the present disclosure collects compressed air from a cylinder of the engine during a compression stroke of an initial engine rotation while the engine is cranking for startup. The compressed air is stored in the accumulator to provide sufficient air volume for operating the fuel preparation system to start the engine. At least one compression cycle may be required to sufficiently charge the air charging system to provide adequate air volume for starting the engine. Air pressure within the accumulator may be monitored during engine start cranking to determine when the firing sequence may commence (e.g., delivery of fuel from a fuel preparation system). Once the engine begins firing, a mechanically or electrically driven (e.g., engine driven) compressor or off-engine compressor may assume responsibility for providing compressed air to the fuel preparation system. In one example, a variable displacement compressor may be applied at transient engine demand volumes, thus reducing parasitic losses at lower volumes.

Some of the example air charging systems disclosed herein may operate to scavenge gases (e.g., air) from a power cylinder of an engine during engine start cranking. The scavenged compressed air may be used with a fuel preparation system such as a dual fluid injection system to start the engine. An example dual fluid injection system and related methods is disclosed in U.S. Patent Publication No. 2011/0284652, which is incorporated herein in its entirety by this reference.

An example air charging system in accordance with the present disclosure includes a charge valve assembly, an accumulator, a control valve and a controller (e.g., an engine control unit (ECU)). The charge valve assembly may include a valve member (e.g., a poppet valve) that provides access into a power cylinder combustion chamber of the engine. Compressed air is extracted from the engine power cylinder through the charge valve assembly during a compression cycle of the engine. The compressed air is stored in the accumulator. The charge valve assembly operates between open and closed positions to collect the compressed air from the engine power cylinder (typically during the compression stroke). Air may be collected from the power cylinder compression stroke in multiple cycles until a threshold pressure is reached in the accumulator. The controller then initiates an engine starting sequence in which compressed air from the accumulator is delivered to an air metering device that supplies compressed air to a fuel delivery device, which delivers fuel to the engine. Once the engine is started, the control valve switches from the accumulator to a compressor that operates under power of the engine, either mechanically or electrically, for supply of compressed air to the air metering device.

A unique control strategy may be used to facilitate charging of the gas (e.g., air) side of the fuel preparation system for engine operation. The control strategy may include a combination of at least some of the following features: a pre-start air pressure check, a pre-start air pre-charge with options for power cylinder enabled charging or external compressor, an engine start condition check, an engine start sequence, an engine afterrun control, an air and fuel pulse timing strategy, an engine load-based variable flow compressor strategy, and a "limp home" power cylinder enabled running mode.

In one example, prior to start, the air pressure may be derived either from an electric pump, externally priming the accumulator via an external air source, or using the engine itself using a separate valve in the combustion chamber. Control logic as to when to allow a start is selectable as to whether an electric pump or the power cylinder charge is used. When a start request is received, the system pressure may be evaluated as to whether it is sufficient to start the engine. If pressure is sufficient, the starter relay is energized. If sufficient pressure is not present, the system pressure may be built until a threshold value is reached. For the electric compressor prime, the air pump relay may be energized prior to the starter relay being energized. For a production application, it may be assumed that the electric prime compressor pump may be energized when the vehicle is unlocked or when a key is inserted into an ignition, if sufficient pressure is present rather than wait until a start request is made to build the pressure.

When using the power cylinder to prime pressure in the system, the engine may be first cranked until the engine position is determined by the engine management system. At that time, a solenoid opens a poppet valve in the cylinder at points between bottom dead center (BDC) and top dead center (TDC) on the compression stroke to provide pressure to the accumulator. The solenoids on each cylinder may be opened each stroke until there is sufficient pressure built. After pressure is attained, the ignition and fuel injection may be allowed so that the engine can start. If the engine fails to start and the air pressure drops below a threshold value, then the ignition/injection is inhibited and a pressure build cycle repeats.

Operation of the air and fuel solenoids for the fuel delivery system is inhibited if insufficient air pressure is available. A limp home strategy may be used in an in-cylinder charge scenario to maintain system pressure by disabling ignition/injection in one or more cylinders for a minimum number of cycles to rebuild pressure. Engine operation at a reduced performance level may be maintained by continuing to fire one or more cylinders during limp home operation.

Referring now to FIG. 1, a schematic diagram of an example air charging system 10 is shown including a charge valve assembly 12, an accumulator 14, a control valve 16, a compressor 18, a one-way valve 20, a controller 22 and an air metering device 24. The charge valve assembly 12 provides flow of gases from the engine cylinder 30. The gases accessed using the charge valve assembly 12 travel through the one-way valve 20 to the control valve 16. The control valve 16 controls flow of the gases to the accumulator 14. Typically, the control valve 16 defaults to the compressor 18 and is directed away from the compressor 18 only during a start cycle for the engine 28. The accumulator 14 is coupled to the air metering device 24. The air metering device 24 controls flow rate and pressure of the air delivered to fuel delivery device 26. The air metering device 24 may include a regulator valve (e.g., a preset or variable valve). The regulator valve may be variable via, for example, the engine control unit (ECU) based on system parameters or duty cycle/demand. The fuel delivery device 26 uses the compressed air from air metering device 24 to generate a fuel charge and deliver the fuel charge to the engine 28. The control valve 16 may operate between a position in which gases flow from the charge valve assembly 12 to the air metering device 24 and a position where air flows from the compressor 18 to the air metering device 24.

Figure 6A:
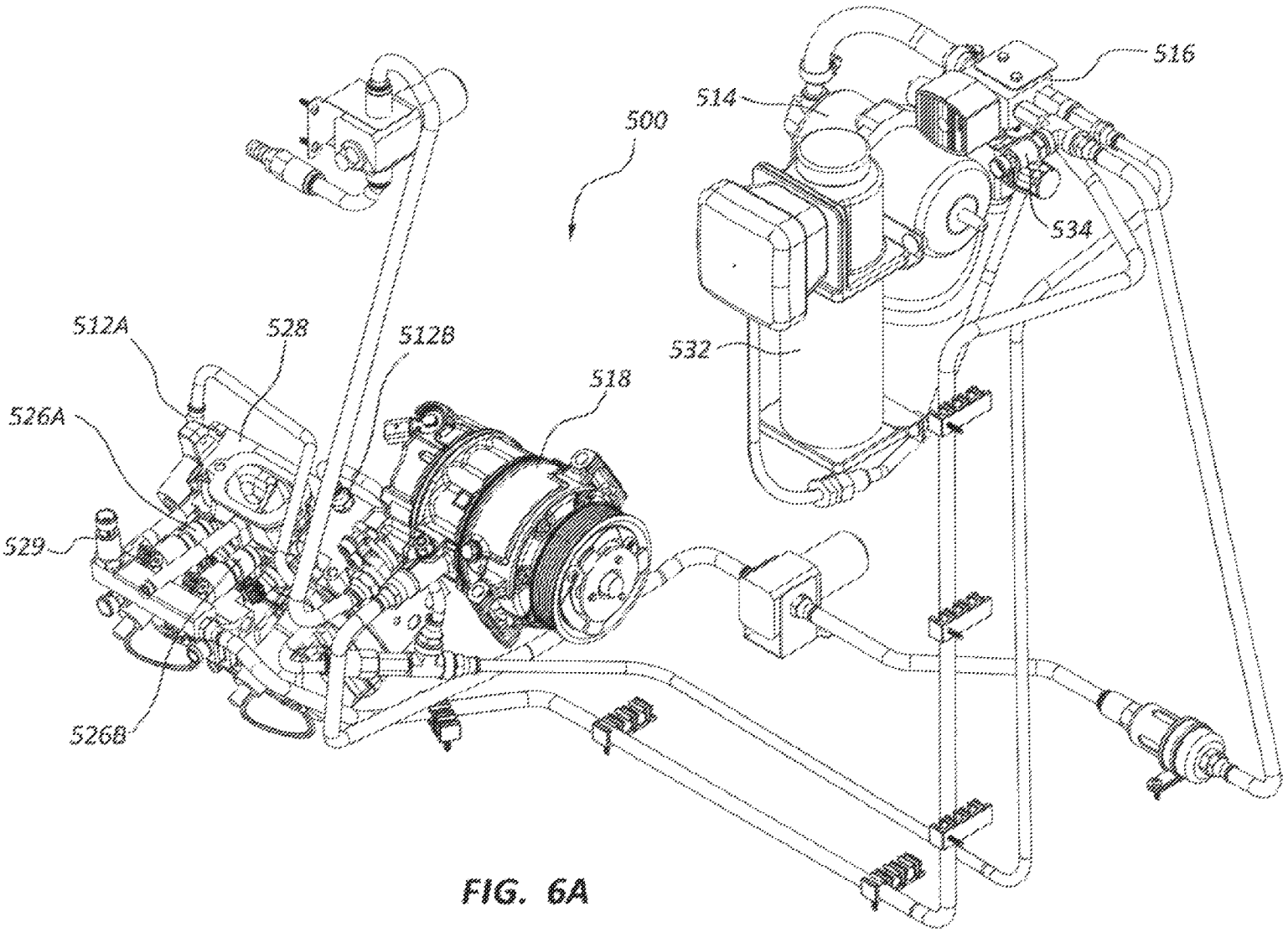
FIGS. 6A and 6B are perspective views of an example air charging system vehicle package in accordance with the present disclosure.

The controller 22 may control operation of a plurality of features of air charging system 10. For example, controller 22 may receive sensor signals from engine 28 related to a position of the piston in engine cylinder 30 to help determine when the charge valve assembly 12 should be operated between opened and closed positions. Sensor signals from the air system (e.g., from sensor 529 on the air supply rail, manifold or other portion of the system as shown in FIG. 6A, which directly communicate air system information) related to the pressure condition within, for example, accumulator 14 and the operated position of the control valve 16, may also be used by controller 22 to help determine, for example, when to initiate an ignition cycle by delivering compressed air from the air metering device 24 to the fuel delivery device 26. Typically, the control valve 16 operates to provide flow communication between accumulator 14 and compressor 18 only after the engine 28 has started and the compressor 18 is operating to generate compressed air.

Figure 7A:
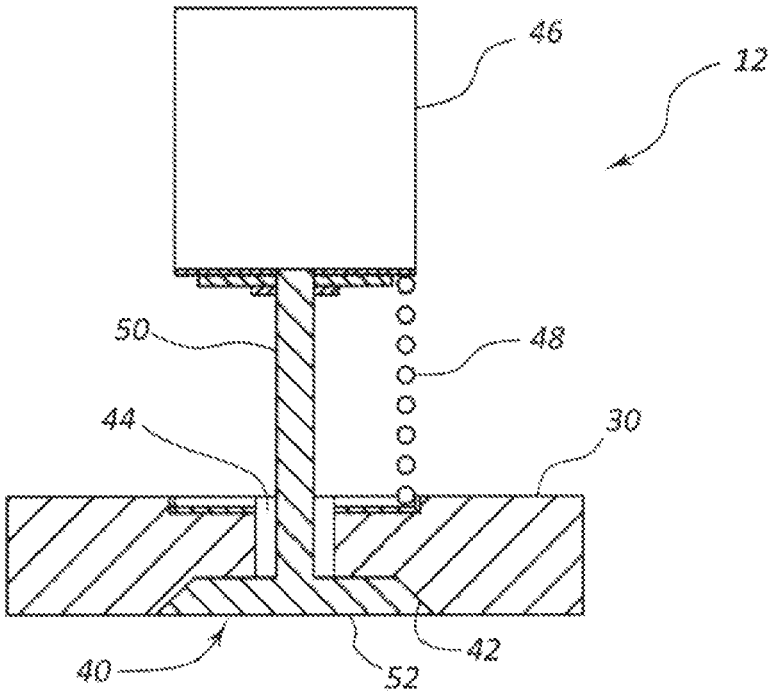
FIGS. 7A and 7B are cross-sectional views of an example valve assembly in accordance with the present disclosure arranged in closed and open positions, respectively.
Figure 7B:
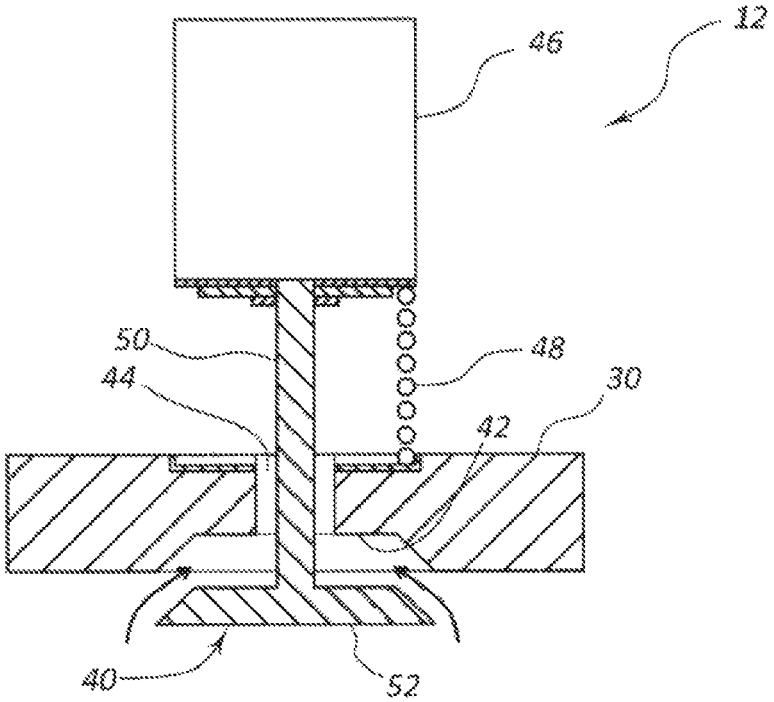

Referring to FIGS. 7A and 7B, an example charge valve assembly 12 is shown and described in further detail. The charge valve assembly 12 includes a valve member 40, a valve seat 42, a valve opening 44, a solenoid 46, and a biasing member 48. The valve member 40 includes a stem 50 and a head 52. The head 52 seals against the valve seat 42 when the charge valve assembly 12 is in a closed position as shown in FIG. 7A. Operating the solenoid 46 moves the head 52 away from the valve seat 42 to permit flow of gases (e.g., air) through the valve opening 44 as shown in FIG. 7B. The biasing member 48 biases the head 52 into the closed position of FIG. 7A.

The charge valve assembly 12 shown in FIGS. 7A and 7B is typically referred to as a poppet valve or poppet valve assembly. Other types of valves may be used in place of a poppet valve such as, for example, a rotary valve. Poppet valves typically provide the advantage of minimum weight requirement, a generally reliable seal at the interface of the head 52 and valve seat 42, and a failure mode into a closed position by operation of the biasing member 48. Further, the poppet valve does not require alteration of the combustion chamber geometry. The poppet valve opens into the combustion chamber in an outward direction, thereby permitting maximum air flow around the valve member 40 and through the valve opening 44 for use by the air charging system 10. Further, the poppet valve may maintain a relatively tight seal when the engine is firing and the piston is moving because the top of the head 52 is forced back into the valve seat 42.

As noted above, a sensor may be used to determine a position of the piston operating in engine cylinder 30. The controller 22 operates the charge valve assembly 12 between closed and opened positions based on a position of the piston operating within engine cylinder 30 (e.g., a crank position). A plurality of sensors may be used, wherein one sensor indicates a crank position while another sensor determines which cycle the cylinder is in. Typically, the charge valve assembly 12 is operated into an open position during a compression stroke and is closed during the remaining crank positions. The charge valve assembly 12 may be opened and closed several times (e.g., an opening cycle) in order to obtain the amount of compressed air in accumulator 14 needed to operate the fuel delivery device 26.

The accumulator 14 may have any desired shape, size, and volume. The accumulator 14 may be a separately formed structure that is mounted outside of engine 28. In an alternative configuration, the accumulator 14 is integrated into the engine 28, such as being formed (e.g., cast) into a portion of the engine block or head. In other arrangements, the accumulator 14 is provided as a separate component. At least one sensor may be associated with accumulator 14 to determine a pressure condition within the accumulator 14. An example accumulator 14 may have a volume in the range of about 1 L to about 3 L, and more preferably about 2 L for a multi-cylinder engine having 4 cylinders.

The control valve 16 may be, for example and without limitation, a three-way valve or a shuttle valve. A control valve 16 operates between a first position in which gases flow from the charge valve assembly 12 to accumulator 14, and a second position in which the flow path from the charge valve assembly 12 to the accumulator 14 is closed and a separate flow path between the compressor 18 and the accumulator 14 is opened. The control valve 16 may be operated between the first and second positions based on, for example, a pressure condition sensed within accumulator 14, an operating state of compressor 18, and an operating condition of engine 28.

The compressor 18 may be a mechanically driven or electric compressor. A mechanically driven compressor 18 is typically operable after the engine 28 has started and is powered by engine 28. An electric compressor may operate using power generated by engine 28 or may draw power from a different power source such as batteries, which are independent of engine operation. Using a mechanically driven compressor 18 may provide a low cost, low weight, simple option for providing the minimum requirements for compressed air for the fuel delivery device 26.

The one-way valve 20 is positioned in the flow line between the charge valve assembly 12 and the accumulator 14 or control valve 16. The one-way valve 20 helps prevent backflow of compressed air collected from the charge valve assembly 12. Additional one-way valves may be positioned at other locations in air charging system 10.

The controller 22 may be part of an engine control unit (ECU). The controller 22 may receive inputs from a variety of sensors of the air charging system 10 and engine 28, and receive feedback concerning operation of various components of the air charging system 10, fuel delivery device 26 and engine 28. At a minimum, the controller 22 typically controls operation of the charge valve assembly 12 between opened and closed positions, controls operation of the control valve 16 between first and second positions, and controls delivery of compressed air stored in accumulator 14 or delivered from compressor 18 to the air metering device 24. The controller 22 may provide other operations and related methods for the air charging system 10.

The air metering device 24 may regulate the flow rate and pressure condition of compressed air stored in the accumulator 14 and delivered to the fuel delivery device 26. In one example, the air metering device 24 provides a flow of air at a pressure of about 4 Bar (58 psi) to about 6 Bar (87 psi) and at a flow rate of about 2.2 kg/hr to about 22 kg/hr.

In the arrangement shown in FIG. 1, the accumulator 14 may act as a buffer for the compressed air being delivered from either the charge valve assembly 12 or the compressor 18 to the air metering device 24. In one example, compressed air supplied via the charge valve assembly 12 may be delivered to the accumulator 14 in short bursts collected during the compression cycle of the engine until a threshold pressure condition is reached in accumulator 14. The compressor 18 may have a compressed air output, which modulates based on, for example, an operating condition of engine 28. The accumulator 14 may regulate or buffer the peak and valley pressures delivered from the source of air pressure (e.g., the engine cylinder 30 or compressor 18) so that conditions of the compressed air delivered to the air metering device 24 are relatively consistent.

Figure 2:
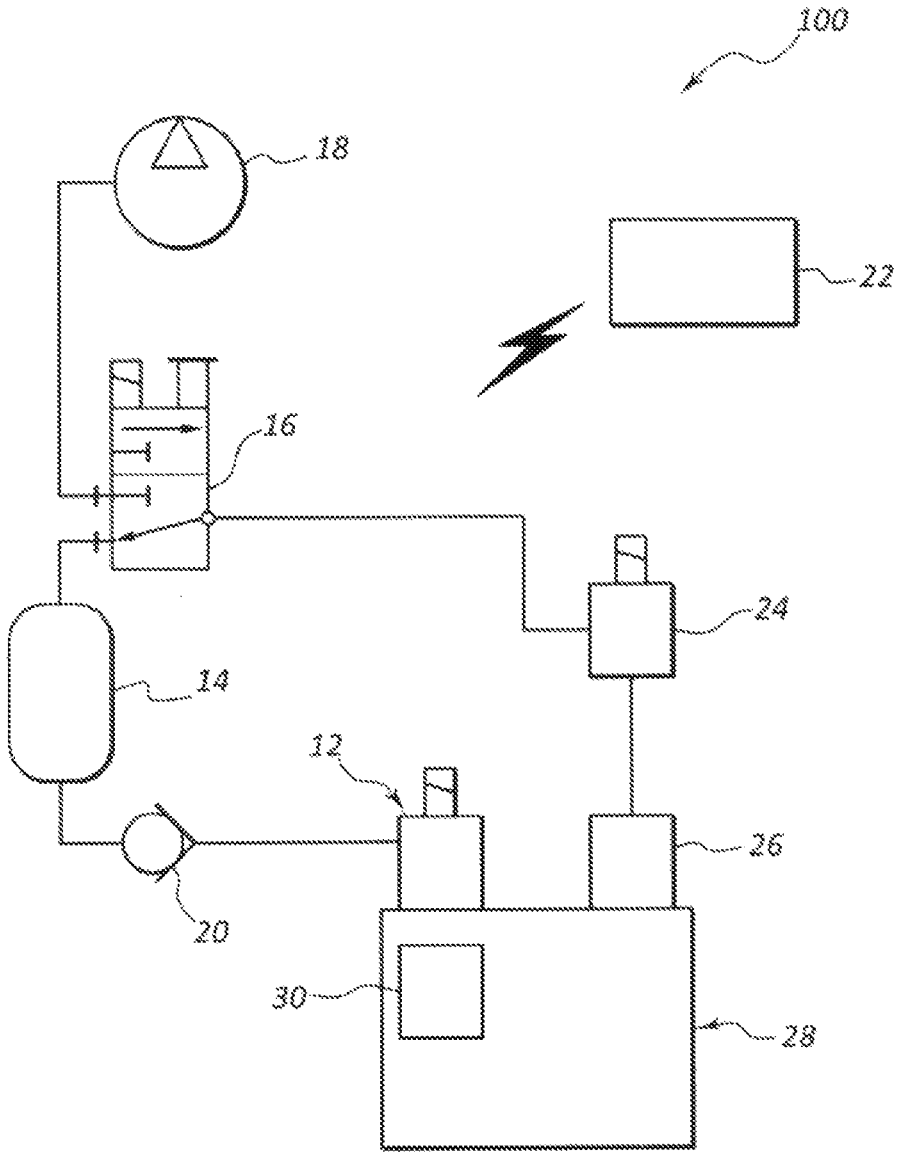
FIG. 2 is a schematic diagram showing another example air charging system in accordance with the present disclosure.

Referring now to FIG. 2, another example air charging system 100 includes a different arrangement for the accumulator 14 relative to control valve 16. FIG. 2 shows the accumulator 14 in the supply line between the charge valve assembly 12 and the control valve 16. The control valve 16 operates to receive air flow from either the accumulator 14 or the compressor 18, and deliver the compressed air to the air metering device 24. The control valve 16 shuttles between the accumulator 14 and the compressor 18 as the source of compressed air.

Figure 3:
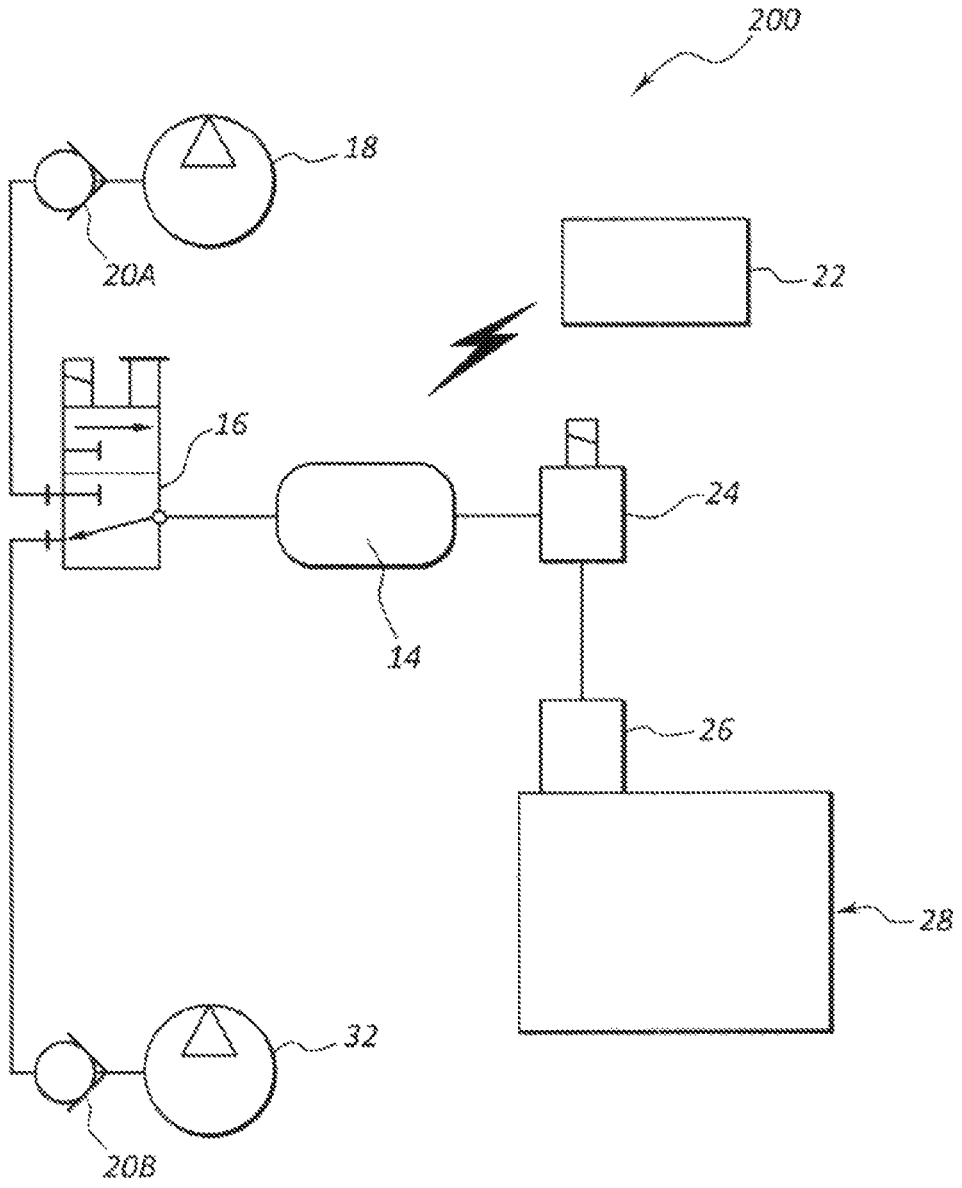
FIG. 3 is a schematic diagram showing another example air charging system in accordance with the present disclosure.

Referring to FIG. 3, another example air charging system 200 includes an electric compressor 32 in addition to a mechanical compressor 18. Both the mechanical compressor 18 and electric compressor 32 may delivery compressed air to the control valve 16. The control valve 16 may regulate air flow into accumulator 14. One-way valves 20*a*, 20*b* may be placed in the lines connecting mechanical compressor 18 and electric compressor 32 to the control valve 16, respectively. The air charging system 200 may be controlled using controller 22 to switch between the mechanical compressor 18 and the electric compressor 32 depending on an operation state of the engine 28. Prior to the engine running, the electric compressor 32 may operate by drawing on stored power (e.g., a battery) of the vehicle to supply compressed air to the accumulator 14. After the engine 28 starts, the electric compressor 32 may be shut down and the mechanical compressor 18 may operate under power of engine 28 to provide a supply of compressed air to accumulator 14.

Figure 4:
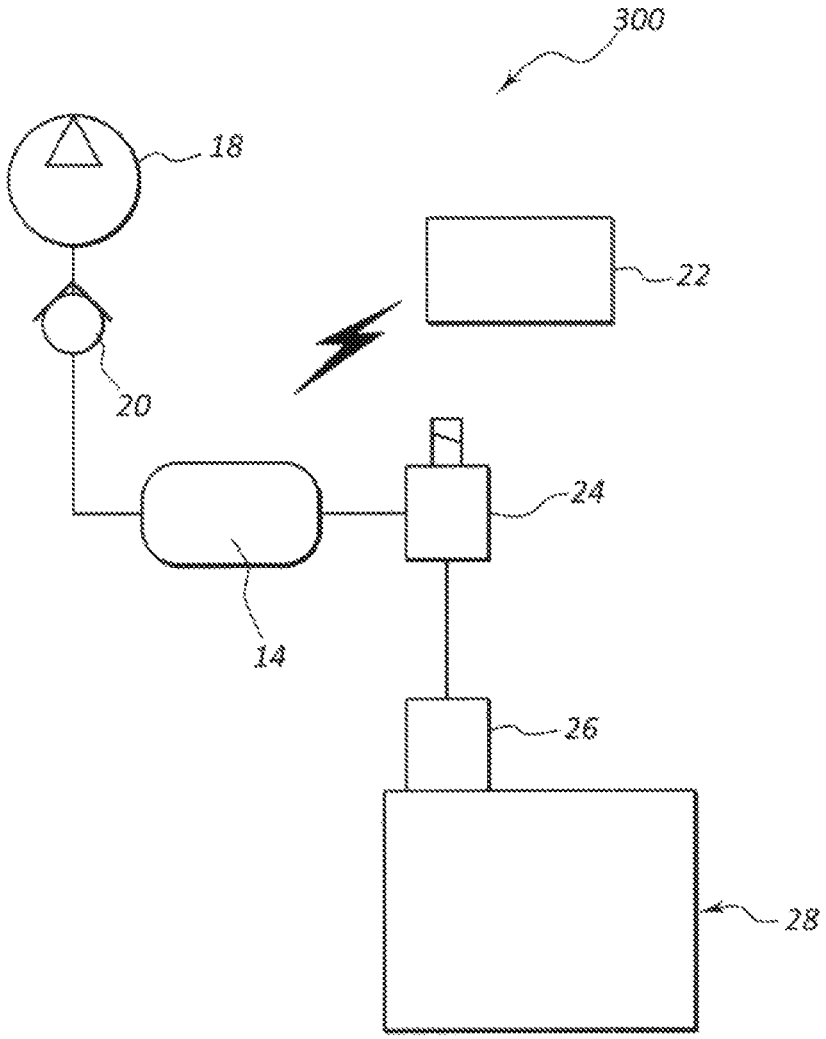
FIG. 4 is a schematic diagram showing another example air charging system in accordance with the present disclosure.

Referring now to FIG. 4, another example air charging system 300 includes only a single source of compressed air using the electric compressor 32. Electric compressor 32 may operate using stored power (e.g., a battery) of the vehicle prior to engine 28 starting to supply pressurized air to accumulator 14. After the engine 28 starts, the electric compressor 32 may operate using electric power generator by engine 28 (e.g., an alternator of engine 28). In at least some arrangements, the power supply used to operate electric compressor 32 may be independent of the power supply of the vehicle and may be charged by engine 28 after the engine 28 is operational. A control valve 16, such as the one discussed above with reference to FIGS. 1-3, may be interposed between the accumulator 14 and the mechanical compressor 18 and the electric compressor 32.

Figure 5:
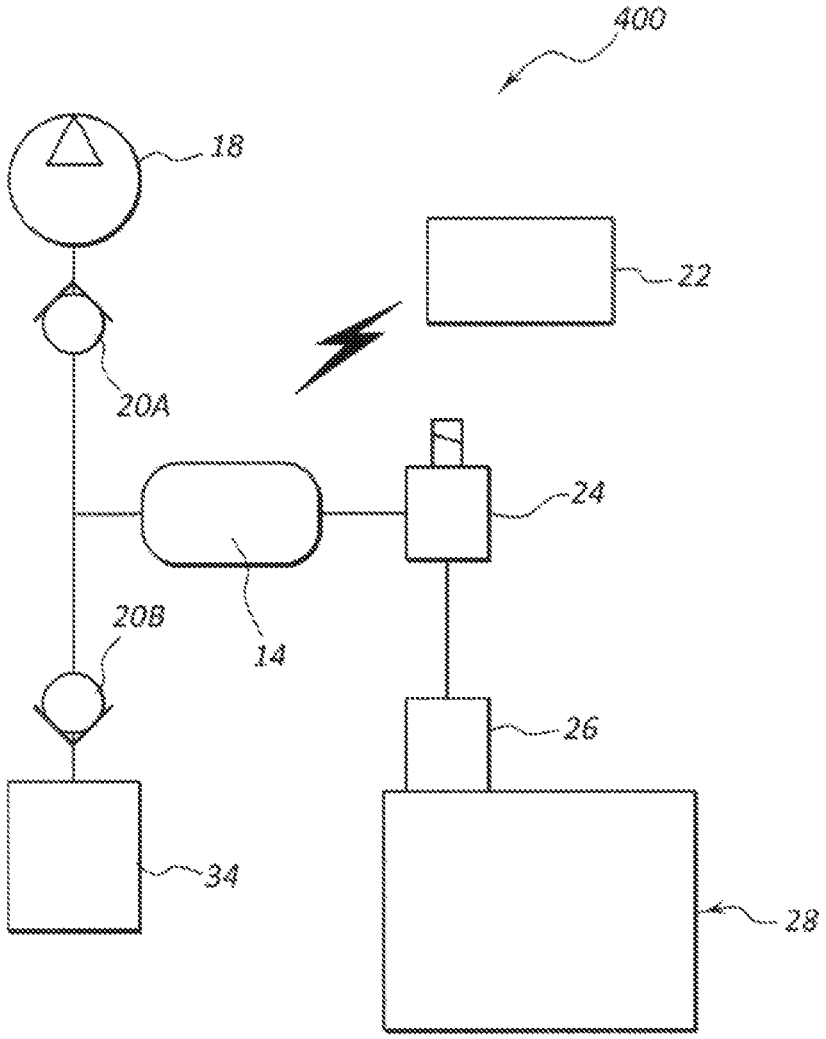
FIG. 5 is a schematic diagram showing another example air charging system in accordance with the present disclosure.

Referring to FIG. 5, another example air charging system 400 shown including a mechanical compressor 18 and an external charge port 34 coupled in flow communication with accumulator 14. In at least some examples, a control valve 16, such as the one described above with reference to FIGS. 1-3, may be interposed between the accumulator 14 and each of the compressor 18 and external charge port 34. The external charge port 34 may be coupled to a source of compressed air completely outside of the air charging system 10. Typically, the external charge port 34 is connected to a secondary source of compressed air, which is operable to charge accumulator 14 with compressed air prior to engine 28 starting. For example, the external charge port 34 may be coupled to a shop air source or a portable air compressor. The external charge port 34 may be used when testing the air charging system 10, testing the engine that uses the air charging system 10, or when conducting maintenance. The compressor 18 usually operates using power from engine 28 after the engine 28 starts.

Figure 6B:
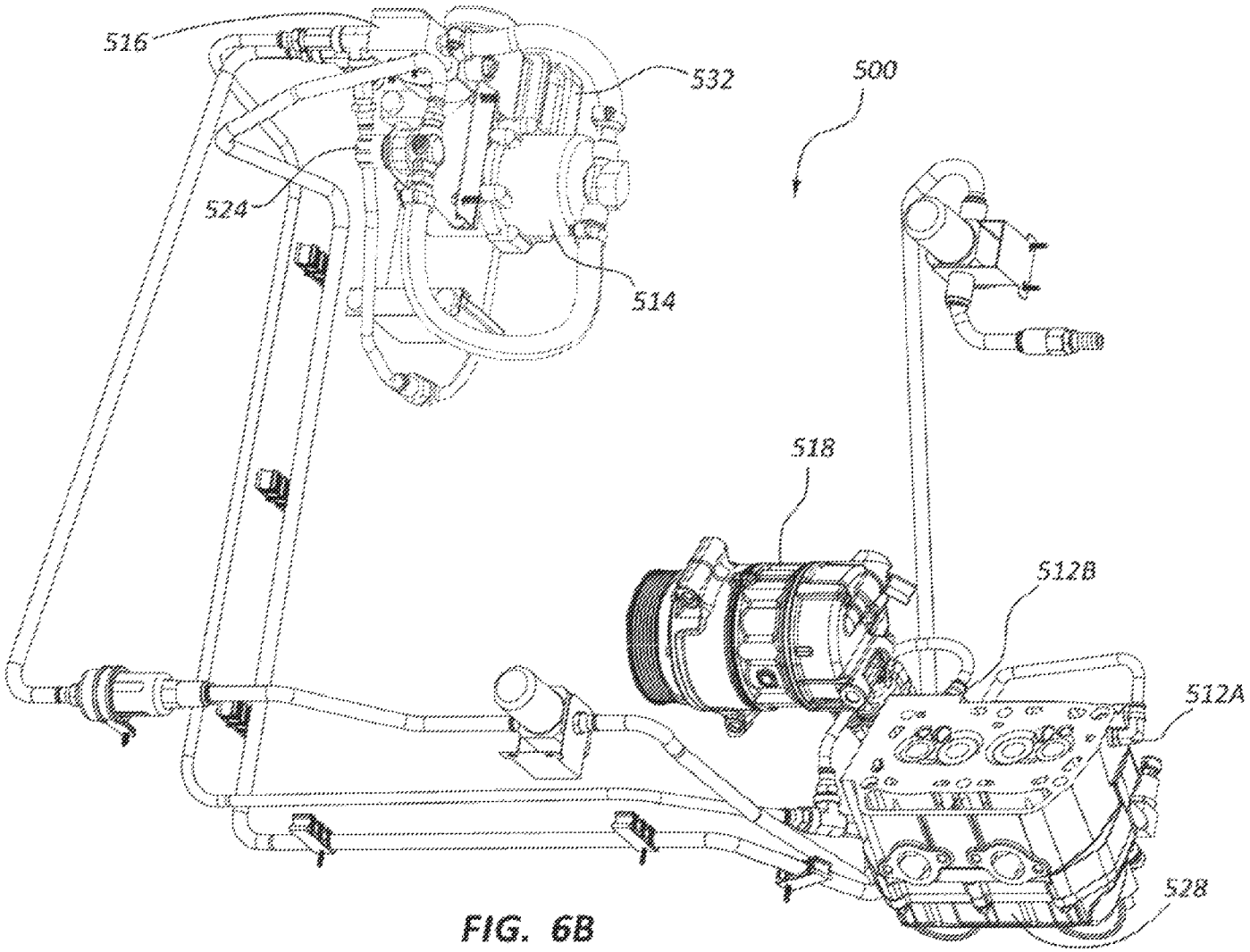

FIGS. 6A and 6B show another example air charging system 500, which is similar in some respects to the schematic air charging system 10 described above with reference to FIG. 1. Air charging system 500 includes first and second charge valve assemblies 512A, 512B, an accumulator 514, a control valve 516, a compressor 518, an air metering device 524 (also referred to as a pressure regulator), and a pressure sensor 534. The air charging system 500 may be connected to first and second fuel delivery devices 526A, 526B, which are mounted to an engine 528. The compressor 518 may be a mechanical (e.g., engine) driven compressor, which operates to provide compressed air after the engine 528 is operating. The air charging system 500 may further, or alternatively, include an electric compressor 532, which may be used to generate compressed air using battery power to charge the accumulator prior to the engine starting, or after the engine is started as an alternative source of compressed air if the compressor 518 or first and second charge valve assemblies 512A, 512B are not operating properly.

The accumulator 514 may be positioned in the line between control valve 516 and the first and second fuel delivery devices 526A, 526B. The first and second charge valve assemblies 512A, 512B may be connected in flow communication with the control valve 516.

Figure 8:
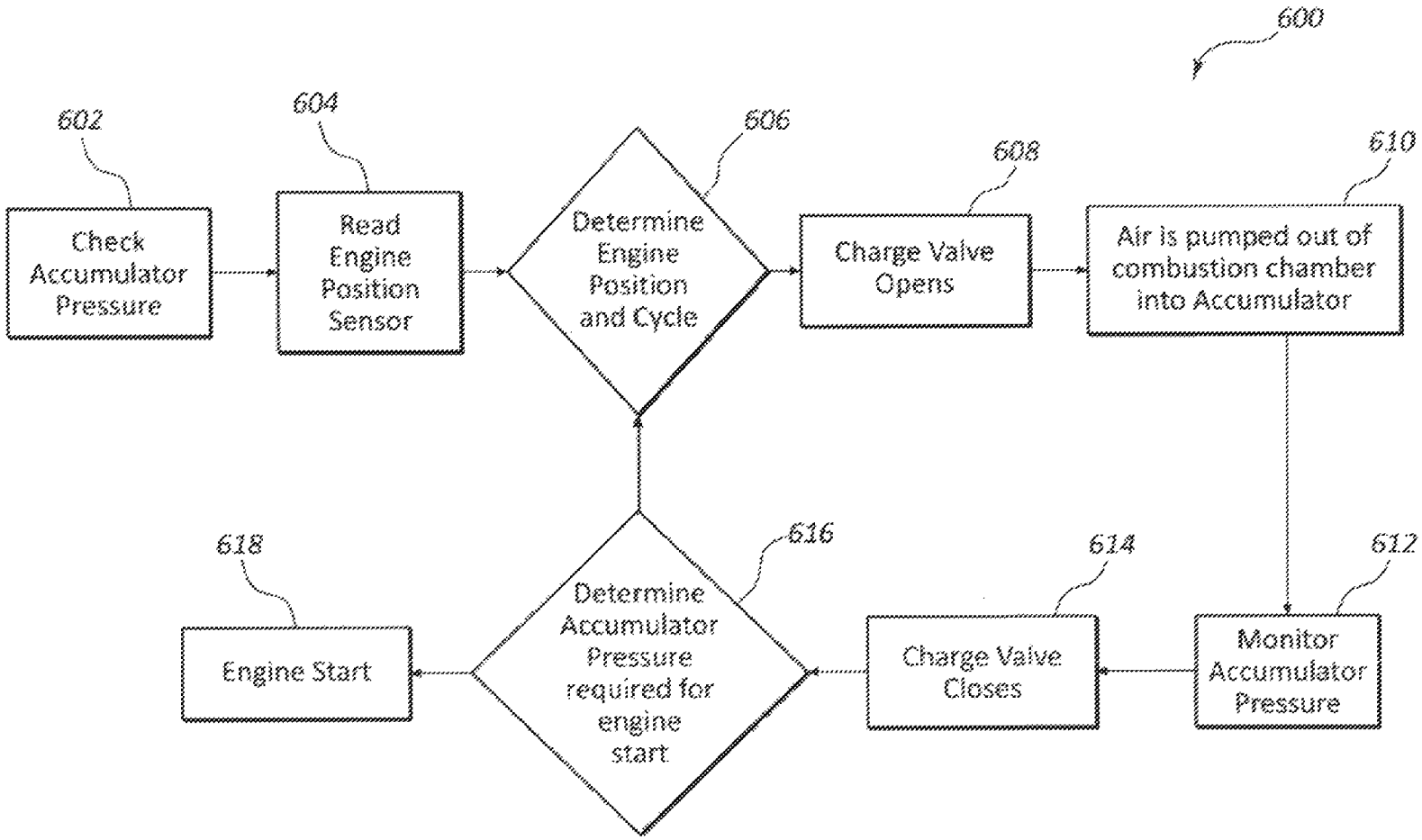
FIG. 8 shows a flow diagram of an example functional strategy in accordance with the present disclosure.

Referring to FIG. 8, an example functional strategy 600 (also referred to as a method 600) of operating any one of the air charging systems 10, 100, 200 described herein is shown. Step 602 of the method may include an initial pressure check within the accumulator 14. If the accumulator pressure is above a threshold pressure level, the system may automatically move to the step 618 of starting the engine by delivering compressed air from the accumulator through the air metering device to a fuel delivery device. If the pressure condition of the accumulator is lower than the threshold level, a step 604 provides reading an engine position sensor to determine an engine position and cycle in a step 606. The charge valve is open in a step 608 during a compression cycle of the engine. Air is moved out of the combustion chamber into the accumulator in a step 610 while the valve is open. The system monitors the pressure condition in the accumulator in a step 612. The charge valve closes in a step 614 when the engine is not in the combustion cycle. When the threshold pressure required for starting the engine (e.g., operating the fuel delivery device) is reached in the accumulator in a step 616, the engine is started in a step 618 by operating the fuel delivery device. If the threshold pressure is not reached in the accumulator, the system returns to step 606 to open the charge valve again to collect additional air from the combustion chamber into the accumulator.

Further steps of the method 600 may include operating the control valve after the engine starts to receive compressed air from a compressor (e.g., a mechanical or electric compressor), which may be operated using power from the engine. The compressed air provided by the compressor may be used to operate the fuel delivery device to continue operation of the engine. The method 600 may be modified as needed to be functional with the air charging systems 300, 400, 500 described with reference to FIGS. 3-5.

At least some of the air charging systems disclosed herein may also be used as back-up systems for the compressor 18 after the engine has started. For example, the compressor may malfunction during operation of the engine. The controller of the air charging system may identify that the compressor has malfunctioned (e.g., senses a drop in pressure supplied to the fuel delivery device via the air metering device), and switch the control valve 16 to receive compressed air from the charge valve assembly for ongoing operation of the engine. This mode may be referred to as a "limp home" mode.

In one example, the accumulator 14 may be charged with an amount of compressed gas that exceeds the amount (e.g., pressure level) needed for operating the fuel delivery device 26. The additional gases collected in the accumulator 14 may be used to operate the engine for a temporary period of time after the engine starts and before the compressor 18 is fully operational and generating sufficient compressed air to operate the fuel delivery device 26. The threshold pressure condition set for the accumulator 14 before initiating the start cycle for engine 28 may be above the minimum amount of air pressure needed to start the engine and/or initially operate the fuel delivery device.

Figure 9:
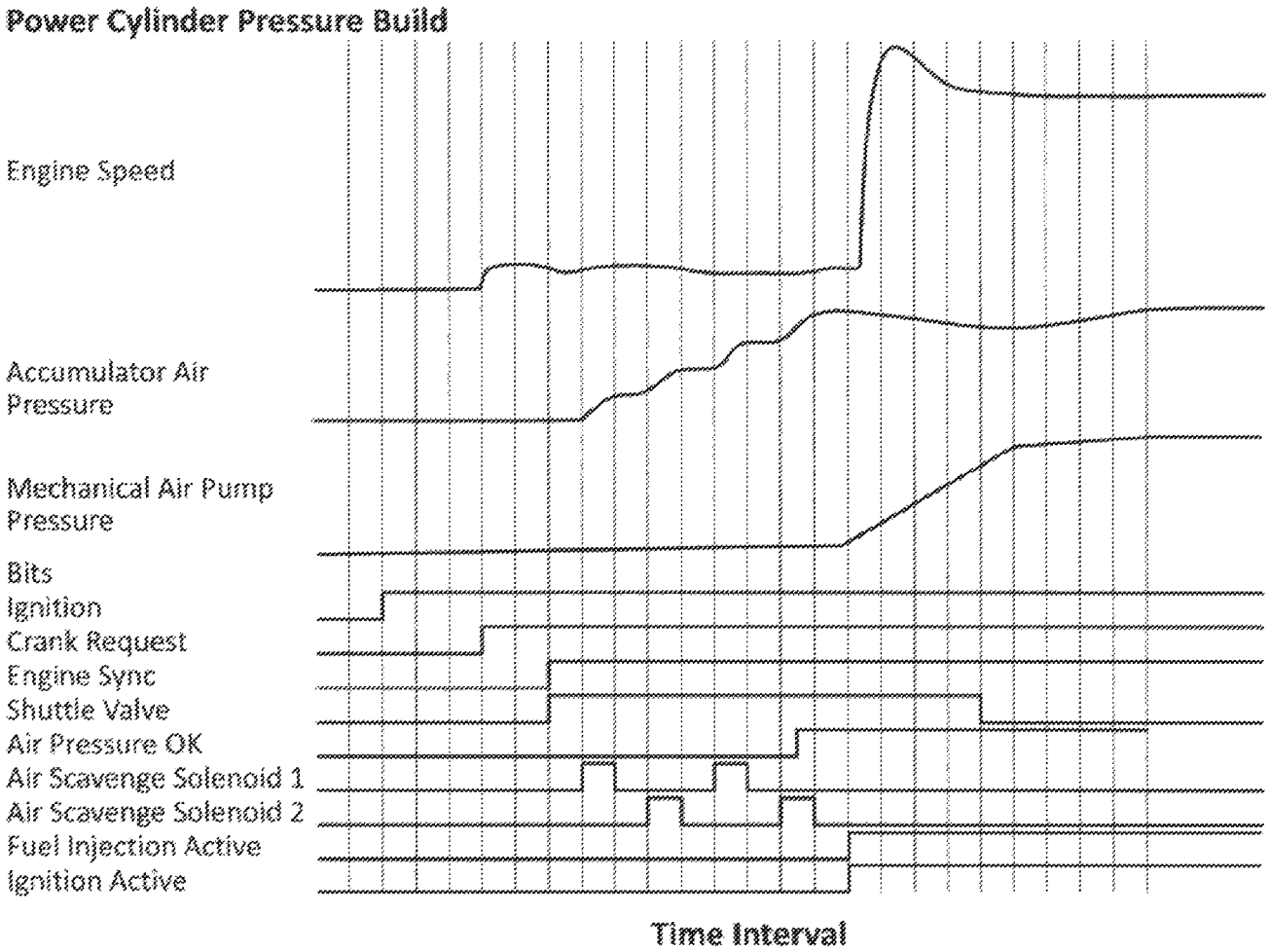
FIG. 9 graphically shows an in-cylinder charge valve operation and pressure build for engine start in accordance with the present disclosure.

FIG. 9 is a graph showing power cylinder pressure build for the air scavenger embodiments of at least FIGS. 1, 2 and 6A-7B described above. The power cylinder pressure build graph includes along the left hand side operations that are being monitored (e.g., engine speed, accumulator air pressure, and mechanical air pump pressure) and internal controls or bits (e.g., ignition, crank request, engine sync, shuttle valve, air pressure OK, air scavenge solenoid 1, air scavenge solenoid 2, fuel injection active, and ignition active). Time intervals are arranged horizontally along the bottom of the graph. The pressure build for this system commences when, for example, a "key on" event is detected by the controller. FIG. 9 shows that a number of steps are executed prior to the fuel injection and ignition becoming active, which generates a jump in engine speed to operation level. The mechanical air pump pressure begins to build after the ignition becomes active. The mechanical air pump pressure maintains pressure in the accumulator after the accumulator pressure has increased beyond a threshold level using the air scavenge solenoids 1 and 2, which results in activation of an "air pressure okay" state.

Figure 10:
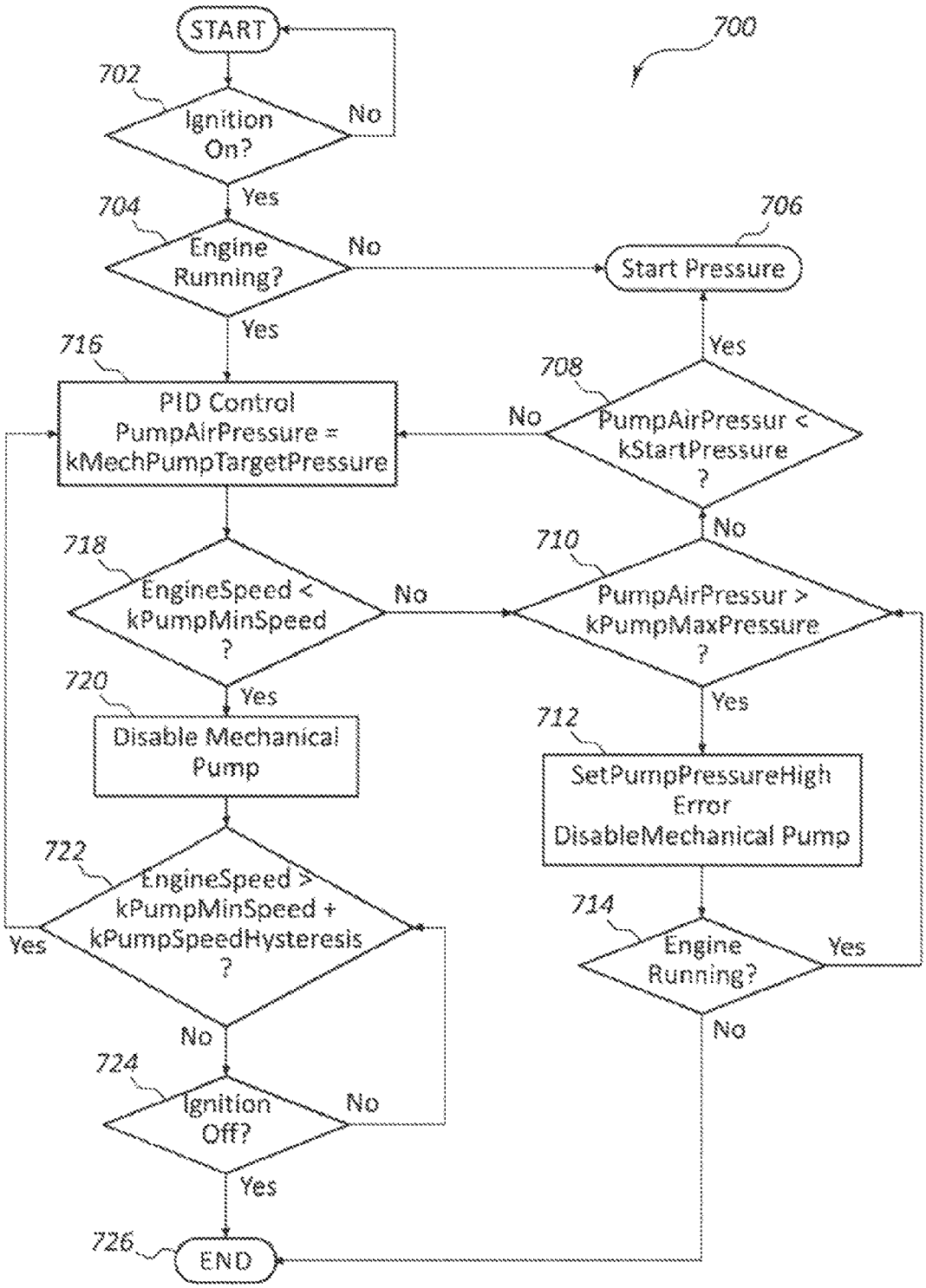
FIG. 10 shows a flow diagram of an example air pressure scheduler in accordance with the present disclosure.

FIG. 10 is a flow diagram showing an air pressure scheduler 700 for an example air charging system. The air pressure scheduler 700 shown in FIG. 10 starts by confirming whether ignition is on in a step 702. If the ignition is not on, the method returns to start. If the ignition is on, an engine running state 704 is checked. If the engine is not running, a subroutine 706 is called to confirm the starting pressure. Aspects of the subroutine 706 are described below. If the pump air pressure is less than the required (e.g., constant or threshold) starting pressure in step 708 then the pressure is checked again. If the engine is already running or the required air pressure to start is available, then a pump air pressure is maintained at a target pressure using a PID controller in a step 716. Step 718 includes confirming whether the engine speed is less than a required pump minimum speed. If it is not, then a step 710 includes confirming whether the pump air pressure is greater than a pump maximum pressure. If it is not greater, then the system returns to step 708. If the condition is met, then a step 712 includes setting the pump pressure high error to disable mechanical pump and a step 714 includes confirming whether the engine is running. If the engine is running, then the system returns to step 710. If the engine is not running, then the system proceeds to the end of the method.

Returning to step 718, if the engine speed is less than the required pump minimum speed, then a step 720 includes disabling the mechanical pump. Step 722 confirms whether the engine speed is greater than the required pump minimum speed plus the pump speed hysteresis. If it is greater, then the system returns to step 716. If the condition is not met, then a step 724 includes confirming whether ignition is off. If the ignition is not off, the system returns to step 722. If the ignition is off, then the system proceeds to end 726, in which the control cycle ceases.

Figure 11:
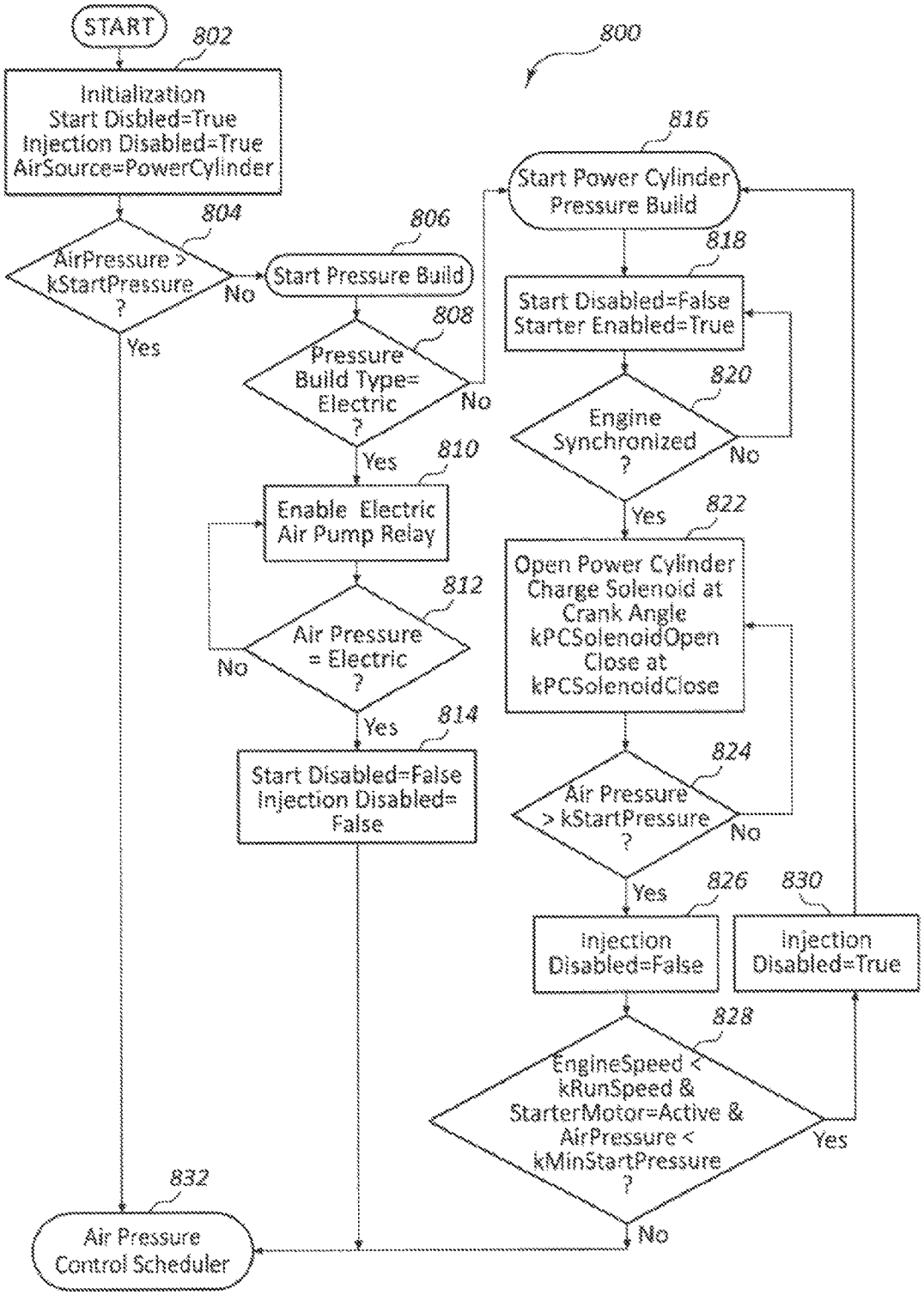
FIG. 11 shows a flow diagram of an example start pressure control in accordance with the present disclosure.

Referring now to FIG. 11, a flow diagram showing a start pressure control procedure 800 is shown. The start pressure control procedure 800 includes beginning with entry into the control strategy and confirming whether initialization step 802 conditions are met. The step 802 may include setting some flags in the system related to whether the start disable is true, the injection disable is true, and the air source is the power cylinder. The step 804 includes confirming whether the air pressure is greater than the required start air pressure. If the condition is met, then a step 832 includes actuating the air pressure scheduler 700 described above with reference to FIG. 10. If the pressure condition is not met, then a step 806 initiates a start pressure build sequence. The sequence 806 includes a step 808 of confirming whether the pressure build type is from an electric pump. If it is, then a step 810 includes enabling an electric air pump relay. A step 812 includes confirming whether the air pressure is greater than a required start pressure. If the air pressure meets the limitation of step 812, the system proceeds to step 814, which enables both injection and start. If a pressure build type is not electric, then a step 816 initiates starting a power cylinder pressure build sequence.

A step 818 disables engine start and enables the starter. A step 820 of confirming whether the engine is synchronized. If the engine is not synchronized in step 820, then the system returns to step 818. If the engine is synchronized, then the system proceeds to step 822 of an open power cylinder charged solenoid at crank angle PC solenoid open and close at PC solenoid close. A step 824 confirms whether the air pressure is greater than the required start pressure. If it is not greater, then the system returns to step 822. If the air pressure condition is met, then the step 826 sets the system as disabled. If so, the system proceeds to a step 828 of the engine speed being less than a run speed, the starter motor being active, and the air pressure being less than a minimum start pressure. If the condition of step 828 is met, then a step 830 sets the injection disable as true and returns to step 816. If the conditions of step 828 are not met, then the system proceeds to the air pressure control scheduler 832.

FIG. 11 shows a start pressure control. A variable flow compressor may be used because it may facilitate reduced parasitic flow to the engine during running conditions where low flow rates are required.

Figure 12:
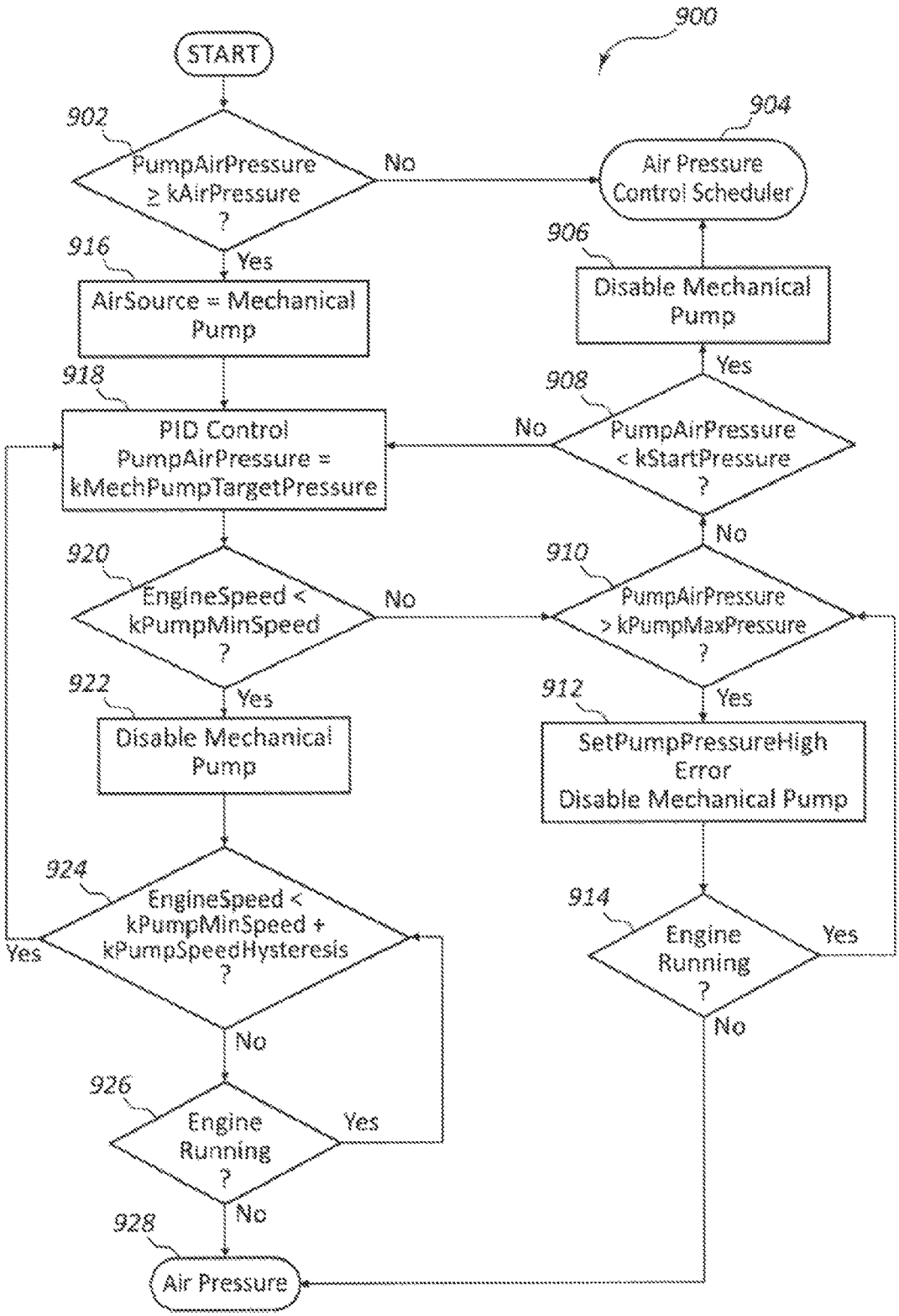
FIG. 12 shows a flow diagram of an example running pressure control in accordance with the present disclosure.

Referring now to FIG. 12, a limp home pressure control strategy 900 is shown in flow diagram format. The pressure control strategy 900 begins with a step 902 of confirming whether a pump air pressure is greater than a required system air pressure. If the condition is not met, then the system moves to an air pressure control scheduler in step 904 (e.g., air pressure scheduler 700). If the air pressure condition of step 902 is met, then an air source being the mechanical pump is checked in a step 916 and a PID control of a pump air pressure being the mechanical pump target pressure is determined in a step 918. A step 920 confirms whether the engine speed is less than the required pump minimum speed. If it is not, the system moves to step 910 where the pump air pressure is confirmed being greater than the pump maximum pressure. If the condition of step 910 is not met, then the system moves to step 908 of confirming whether the pump air pressure is less than the required start pressure. If that condition is met, then the system moves to step 906 of disabling the mechanical pump and moving to step 904. If the condition of step 908 is not met, then the system moves to step 918.

Returning to the step 910, if the pressure condition is met, the system moves to step 912 of setting the pump pressure high error disable and disabling the mechanical pump, followed by confirming whether the engine is running in a step 914. If the engine is not running, the system returns to step 910. If the engine is confirmed to not be running, then the system moves to an air pressure check 928 (e.g., the air pressure step 804 described above with reference to FIG. 11).

Referring again to step 920, if the engine speed requirement is met, then the system disables the mechanical pump in a step 922 and confirms whether the engine speed is greater than the pump minimum speed plus the pump speed hysteresis in a step 924. If the condition of step 924 is not met, then the system proceeds to a step 926 of determining whether the engine is running. If the engine is running, the system returns to step 924. If the engine is not running, the system proceeds to the air pressure step of 928. Returning to step 924, if the engine speed condition is met, then the system returns to step 918.

Figure 13:
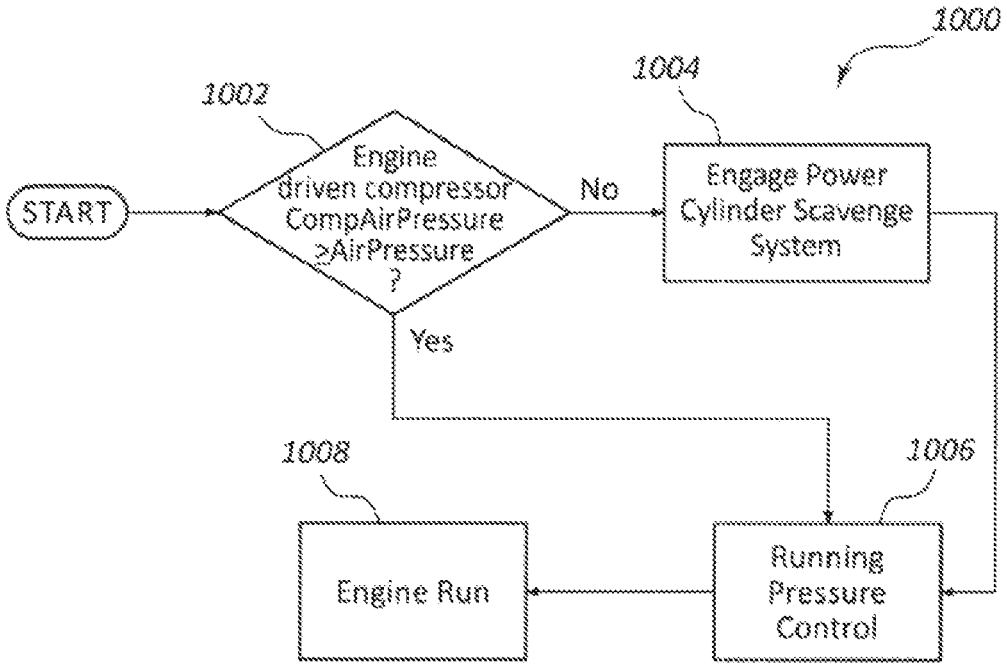
FIG. 13 shows a flow diagram of an example limp home pressure control for an engine scavenge arrangement in accordance with the present disclosure.
Figure 14:
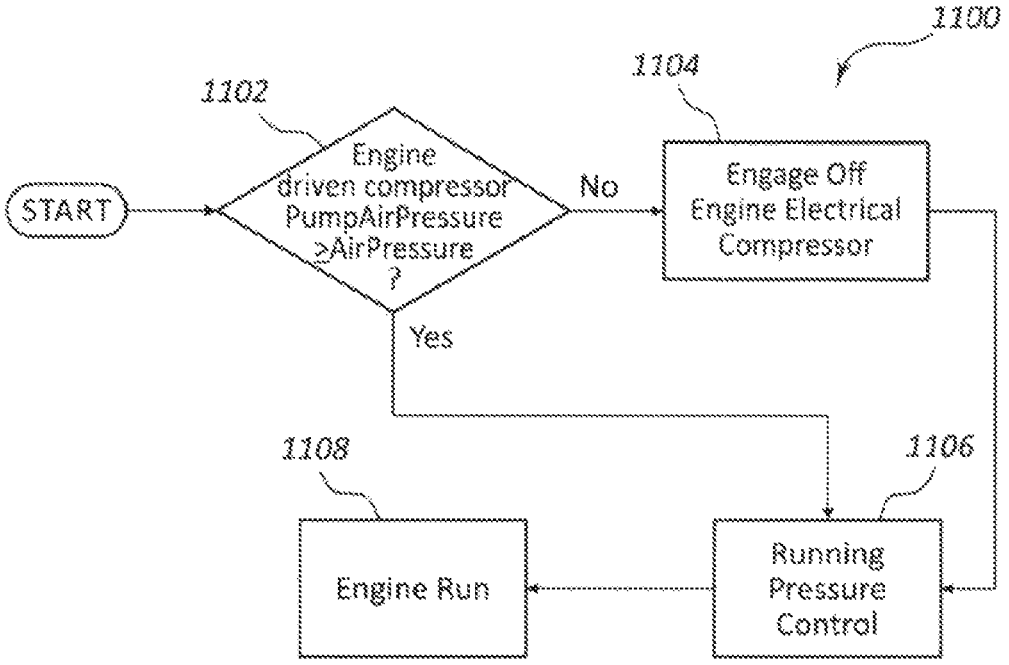
FIG. 14 shows a flow diagram of an example limp home pressure control for an electric compressor arrangement in accordance with the present disclosure.

The pressure control strategies of FIG. 10-12 may provide a "limp home" pressure control for a power cylinder scavenger supplied air system. FIGS. 13 and 14 show additional strategies or portions of strategies specific to "limp home" pressure control. FIG. 13 shows a strategy 1000 beginning with a step 1002 of confirming whether the mechanically driven compressor pump air pressure is greater than a required air pressure. If condition 1002 is not met, the system moves to step 1004 of engaging the power cylinder scavenger system and moving to step 1006 of running pressure control and the step 1008 of the engine running. If the step 1002 conditions are met, then the system moves to step 1006 of running a pressure control and on to the step 1008 of the engine running.

FIG. 14 shows another strategy 1100, which after starting moves to a step 1102 of confirming whether the mechanically driven compressor pump air pressure is greater than the required air pressure. If the condition of step 1102 is not met, then the system proceeds to step 1104 of engaging an off engine electrical compressor, running a pressure control in a step 1106, and running the engine in a step 1108. If the condition of step 1102 is met, then the system moves automatically to step 1106 of running a pressure control and on to the step 1108 of running the engine.

Figure 15:
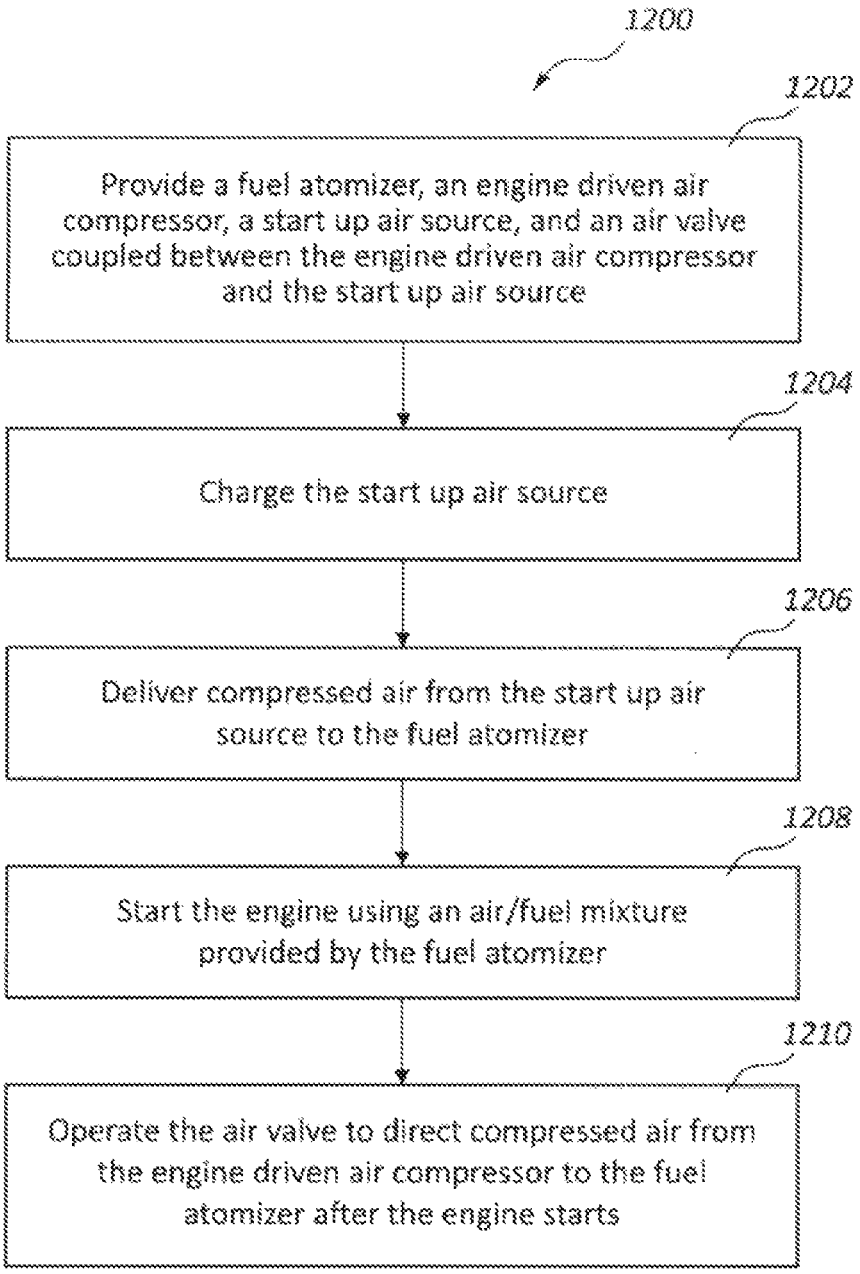
FIGS. 15-17 show flow diagrams of further example functional strategies in accordance with the present disclosure.

FIG. 15 shows a flow diagram for an example method 1200 (also referred to as a functional strategy 1200) of controlling fuel delivery to an engine. Method 1200 includes a step 1202 of providing a fuel atomizer, a mechanically driven air compressor, a startup air source, and an air valve coupled between the mechanically driven air compressor and the startup air source. A step 1204 includes charging a startup air source. A step 1206 includes delivering compressed air from the startup air source to the fuel atomizer. The engine is started using an air/fuel mixture provided by the fuel atomizer in a step 1208. A step 1210 includes operating the air valve to direct compressed air from the mechanically driven air compressor to the fuel atomizer after the engine starts.

The method 1200 may also include providing the startup air source with an electrically driven air compressor. The startup air source may comprise an accumulator, and charging the startup air source may include delivering compressed air from one of the cylinders of the engine and an electrically driven air compressor to the accumulator. The startup air source may include a one-way valve, and charging the startup air source may include controlling air flow from the cylinder to the accumulator. A method 1200 may include providing a valve into the cylinder and determining an engine position and cycle before opening the valve. The method may include determining a pressure of the accumulator before delivering compressed air from the startup air source to the fuel atomizer. Charging the startup air source may include delivering compressed air from the electrically driven compressor to the accumulator. The method 1200 may include operating the mechanically driven air compressor to generate compressed air after starting the engine. The mechanically driven air compressor may generate an insufficient amount of pressurized air, and delivering compressed air from the startup air source to the fuel atomizer may maintain the engine running.

Figure 16:
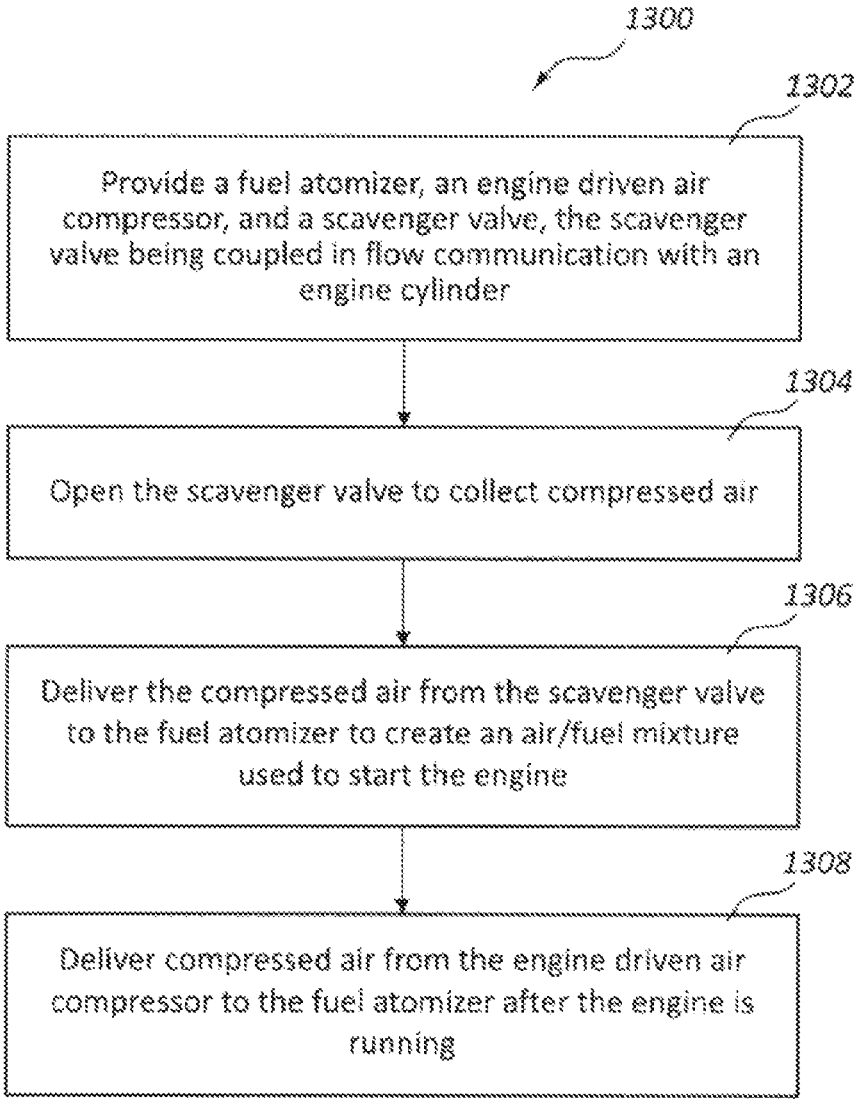

FIG. 16 shows another example method 1300 (also referred to as a functional strategy 1300) for controlling air flow to a fuel atomizer. The method 1300 includes a step 1302 of providing a fuel atomizer, a mechanically driven air compressor, and a scavenger valve, wherein the scavenger valve is coupled in flow communication with an engine cylinder. A step 1304 includes opening the scavenger valve to collect compressed air. A step 1306 includes delivering the compressed air from the scavenger valve to the fuel atomizer to create an air/fuel mixture used to start the engine. A step 1308 includes delivering compressed air from the mechanically driven air compressor to the fuel atomizer after the engine is running.

Other steps related to method 1300 may include providing an air control valve coupled between the mechanically driven air compressor, the scavenger valve, and the fuel atomizer, wherein the method includes operating the air control valve to direct compressed air from the mechanically driven air compressor or the scavenger valve to the fuel atomizer depending on whether the engine is running. The method 1300 may include providing an accumulator coupled in flow communication between the scavenger valve and the fuel atomizer, and providing a one-way valve between the accumulator and the scavenger valve to prevent backflow of compressed air into the engine cylinder. The method 1300 may include opening the scavenger valve at points between bottom dead center (BDC) and top dead center (TDC) on a compression stroke of the engine. The accumulator may be coupled in flow communication between the mechanically driven compressor and the fuel atomizer, and the accumulator may regulate pressure of the compressed air delivered to the fuel atomizer.

Figure 17:
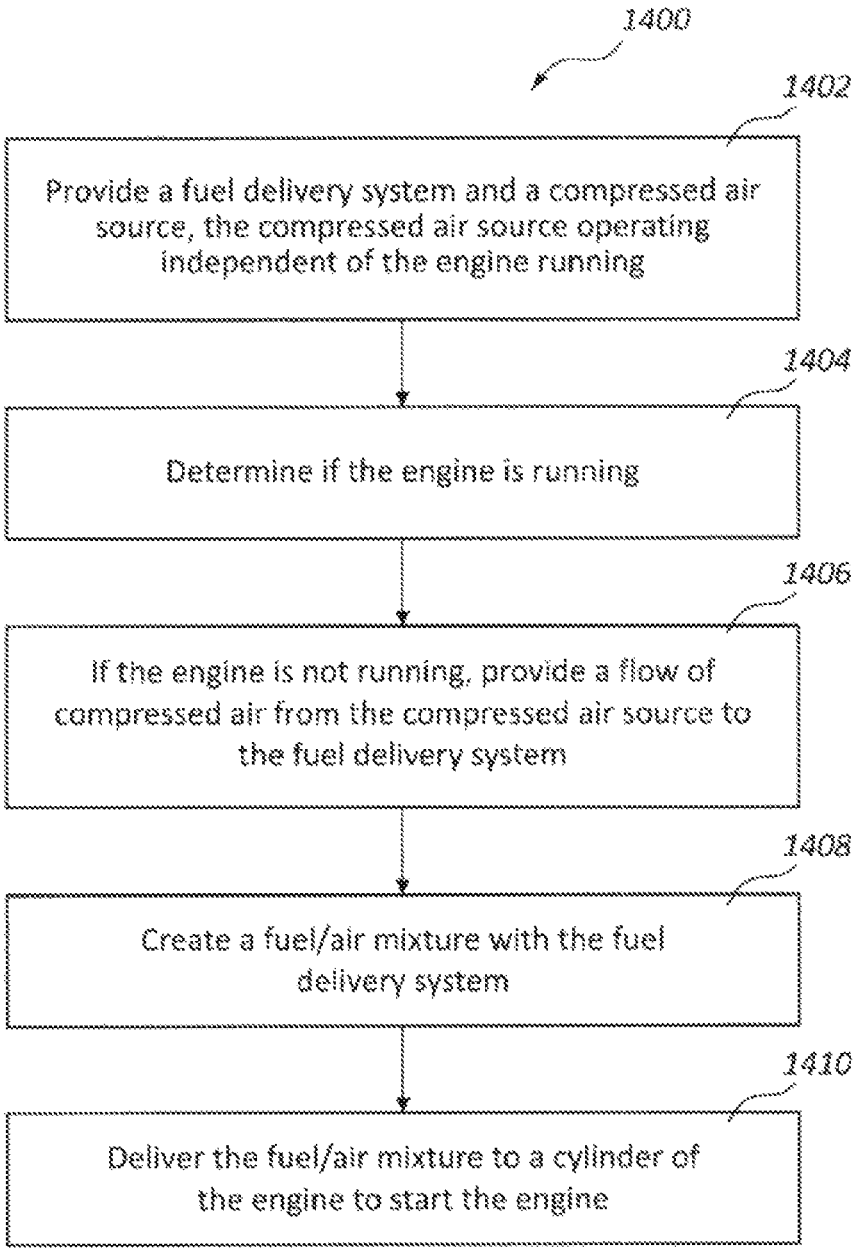
Figure 19:
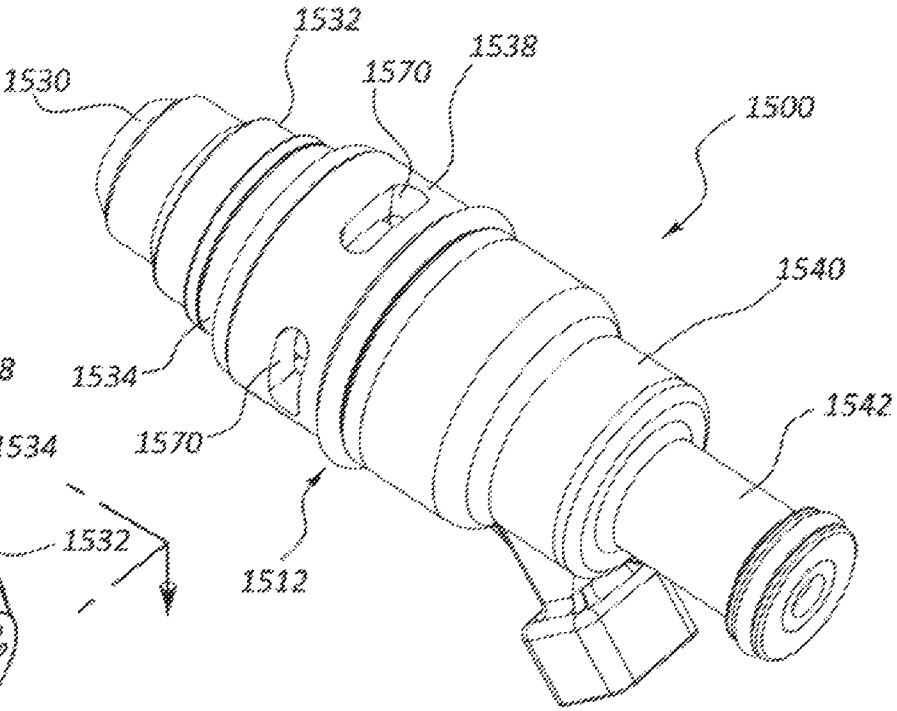
FIGS. 18 and 19 are perspective views of an example fuel delivery device in accordance with the present disclosure.
Figure 18:
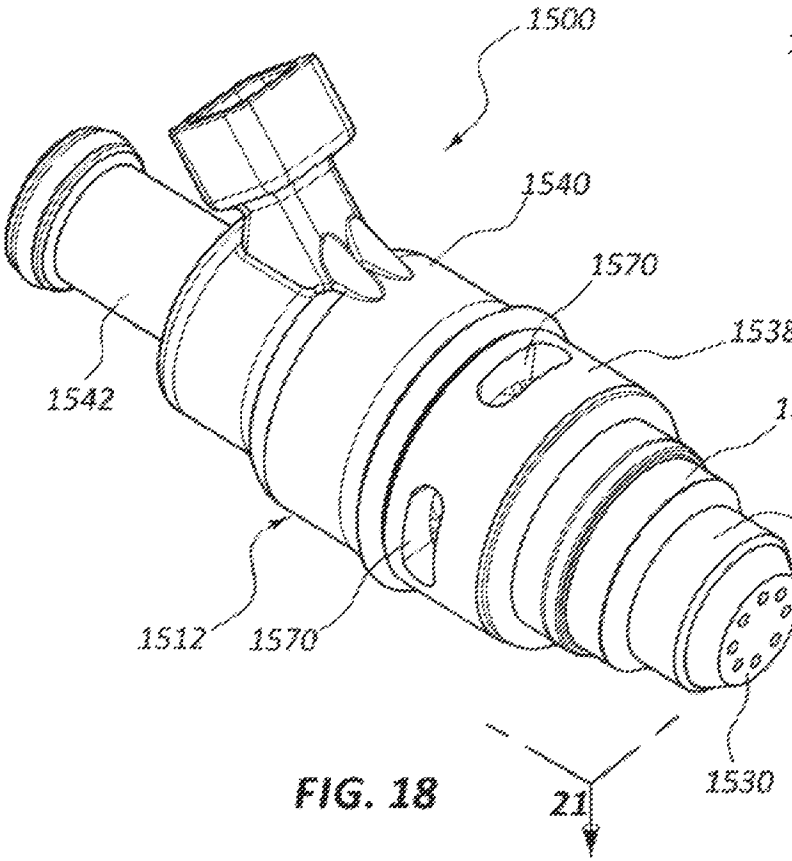
Figure 20:
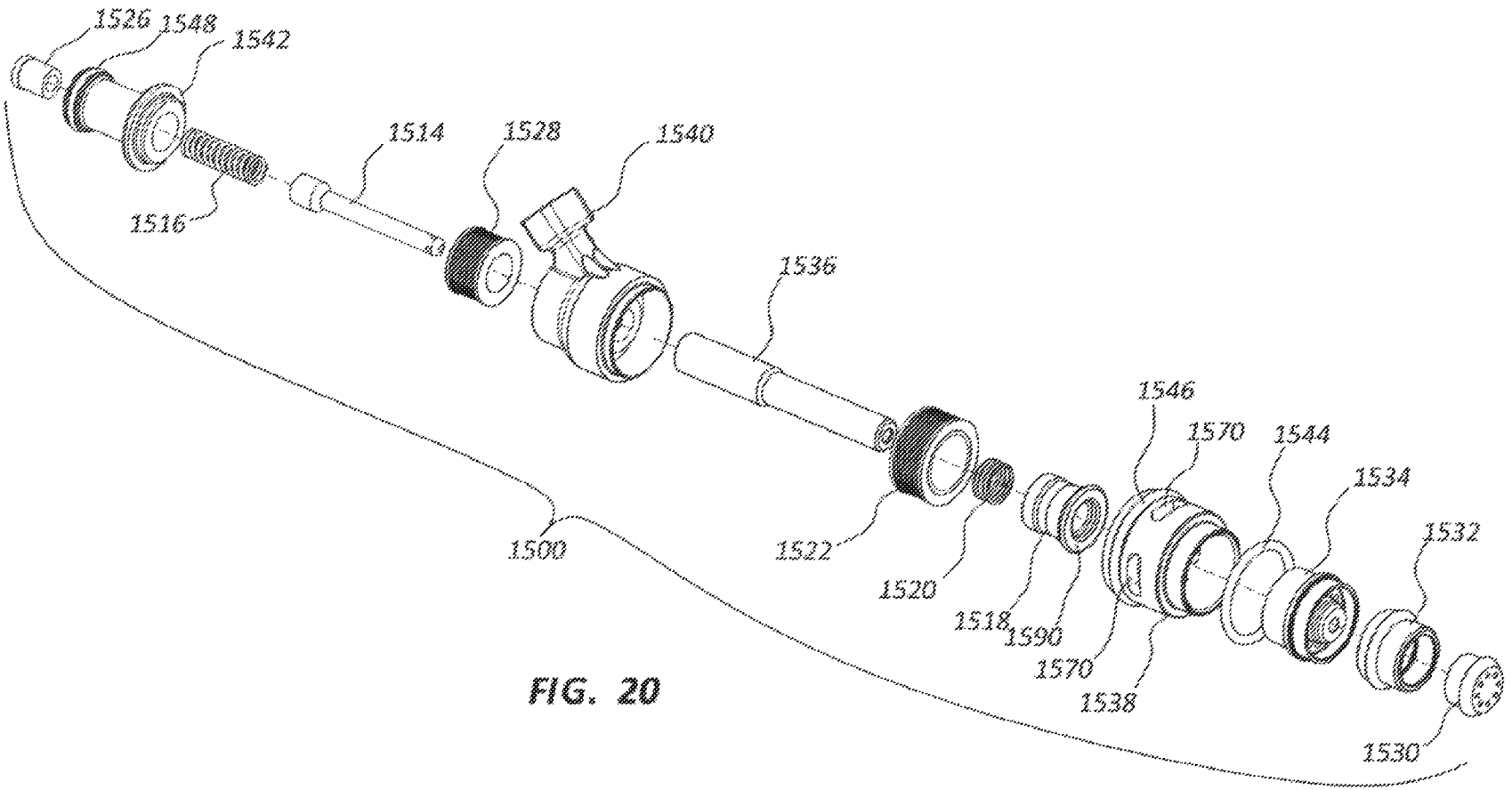
FIG. 20 is an exploded perspective view of the fuel delivery device of FIGS. 18-19.

FIG. 17 shows another example method 1400 (also referred to as a functional strategy 1400) of starting an internal combustion engine. The method 1400 includes a step 1402 of providing a fuel delivery system and a compressed air source, wherein the compressed air source operates independent of the engine running. A step 1404 includes determining if the engine is running. If the engine is not running, a step 1406 includes providing a flow of compressed air from the compressed air source to the fuel delivery system. A fuel/air mixture is created with the fuel delivery system in a step 1408, followed by delivery of the fuel/air mixture to a cylinder of the engine to start the engine at a step 1410.

Other steps of the method 1400 may include providing the compressed air source with an accumulator and an air compressor, and operating a compressor to collect a charge of compressed air in the accumulator. The compressed air source may include an accumulator and a scavenger valve, the scavenger valve being coupled to a cylinder of the engine, and the method 1400 includes operating the scavenger valve to collect compressed air from the cylinder when turning over the engine and before starting the engine, and delivering the compressed air to the accumulator. The compressed air source may include first and second compressed air sources, the first compressed air source may operate before the engine starts in the second compressed air source is powered by the engine after the engine starts. The first compressed air source may include one of an electrically driven compressor and a cylinder scavenger valve, and the second compressed air source may include one of a mechanically driven (e.g., engine driven) compressor and an electrically driven compressor. The method 1400 may include providing a controller and a plurality of sensors, wherein the controller initiates delivery of the air/fuel mixture to the engine after a threshold air pressure is available from the compressed air source.

Referring now to FIGS. 18-21, an example fuel delivery device 1500 for use with the systems, methods and strategies described above is shown and described. The fuel delivery device 1500 may include at least some aspects of the fuel delivery device 26 described above with reference to FIGS. 1-5. Additional details concerning the example fuel delivery device 1500 of FIGS. 18-21 are described in U.S. patent application Ser. No. 13/857,689, filed on 5 Apr. 2013, [the 0.0127 application] which is incorporated herein in its entirety by this reference.

The fuel delivery device includes a housing assembly 1512, a fuel plunger 1514, a fuel spring 1516, an air plunger 1518, an air spring 1520, a first solenoid 1522, a fuel filter 1526, and a second solenoid 1528. The first solenoid 1522 operates with the air spring 1520 to move the air plunger 1518 between open and closed positions. The second solenoid 1528 operates with the fuel spring 1516 to move the fuel plunger 1514 between open and closed positions. The first solenoid 1522 includes a bore 1596 within which at least the air plunger 1518 extends. The second solenoid 1528 includes a bore 1598 within which at least the fuel plunger 1514 extends. The fuel filter 1526 includes a distal surface against which a proximal surface of the air spring 1520 contacts.

The housing assembly 1512 includes a delivery tip 1530 (also referred to as a nozzle), a lower mix housing 1532, an upper mix housing 1534, a fuel inner housing 1536, an air housing 1538, a solenoid housing 1540, and a cover housing 1542. The housing assembly 1512 also includes first, second and third o-rings 1544, 1546, 1548.

The delivery tip 1530 includes a mixing chamber 1552. The upper mix housing 1534 includes a fuel aperture 1554, a fuel cavity 1556, a plurality of air channels 1558, an air sealing seat 1560, and an air aperture 1562. The fuel inner housing 1536 includes a plunger seat 1564 and a fuel aperture 1566. The air housing 1538 includes an air cavity 1568 and a plurality of air inlets 1570. The solenoid housing 1540 includes a first solenoid seat 1572, an air spring seat 1576, and a second solenoid seat 1578. The cover housing 1542 includes a bore 1580 sized to receive the fuel filter 1526.

The fuel plunger 1514 includes a distal sealing surface 1582, an axial fuel channel 1584, a lateral fuel channel 1586 and a spring seat 1588. The air plunger 1518 includes a distal sealing surface 1590, a plunger bore 1592, and a proximal surface 1594. The air plunger 1518 may be referred to as a valve member.

The distal sealing surface 1582 of the fuel plunger 1514 is arranged to contact the plunger seat 1564 of the fuel inner housing 1536 and to control fluid flow from a fuel cavity 1556 within the fuel inner housing 1536 into the mixing chamber 1552. The distal sealing surface 1590 of the air plunger 1518 is arranged to contact the air sealing seat 1560 of the upper mix housing 1534 to control airflow from the air cavity 1568 into the mixing chamber 1552. The fuel inner housing 1536 and fuel plunger 1514 move axially in a direction independent of axial movement of the air plunger 1518. This independent movement may make it possible to move the fuel plunger 1514 and air plunger 1518 in any desired sequence to control the flow of air and fuel into the mixing chamber 1552. Further, the independent control provided by the embodiment of FIGS. 18-21 may make it easier to control the delays between opening and closing the fuel plunger 1514 and air plunger 1518. The air plunger 1518 of fuel delivery device 1500 may require exchange of the fuel and air springs or changing the fuel and air pressures in order to change the delay between the opening and closing of each of the fuel and air plungers.

Various bulk air supplied geometries may provide control of air flow from the air cavity 1568 into the air aperture 1562. Air may be delivered into the air cavity 1568 using, for example, at least one channel, a manifold, a rail, or similar common supply that delivers air through the air inlet into the air cavity 1568. In some arrangements, the air may be delivered to the air cavity 1568 using a plurality of channels as will be discussed in further detail below.

The air plunger 1518 (also referred to as a gas flow controller) may be operable to provide concurrently a substantially uniform flow of compressed air to each of the air apertures 1562. Air enters the air cavity 1568 via the air inlets 1570. The air is supplied via, for example, a channel, manifold or rail. The air may deadhead at an opposite side of the air cavity 1568 (e.g., against an outer surface of the air plunger 1518). The air fills the air cavity 1568 with an equalized pressure. Moving the air plunger 1518 away from the air sealing seat 1560 of the upper mix housing 1534 exposes the air apertures 1562 to the supply of equalized pressure air.

Figure 21:
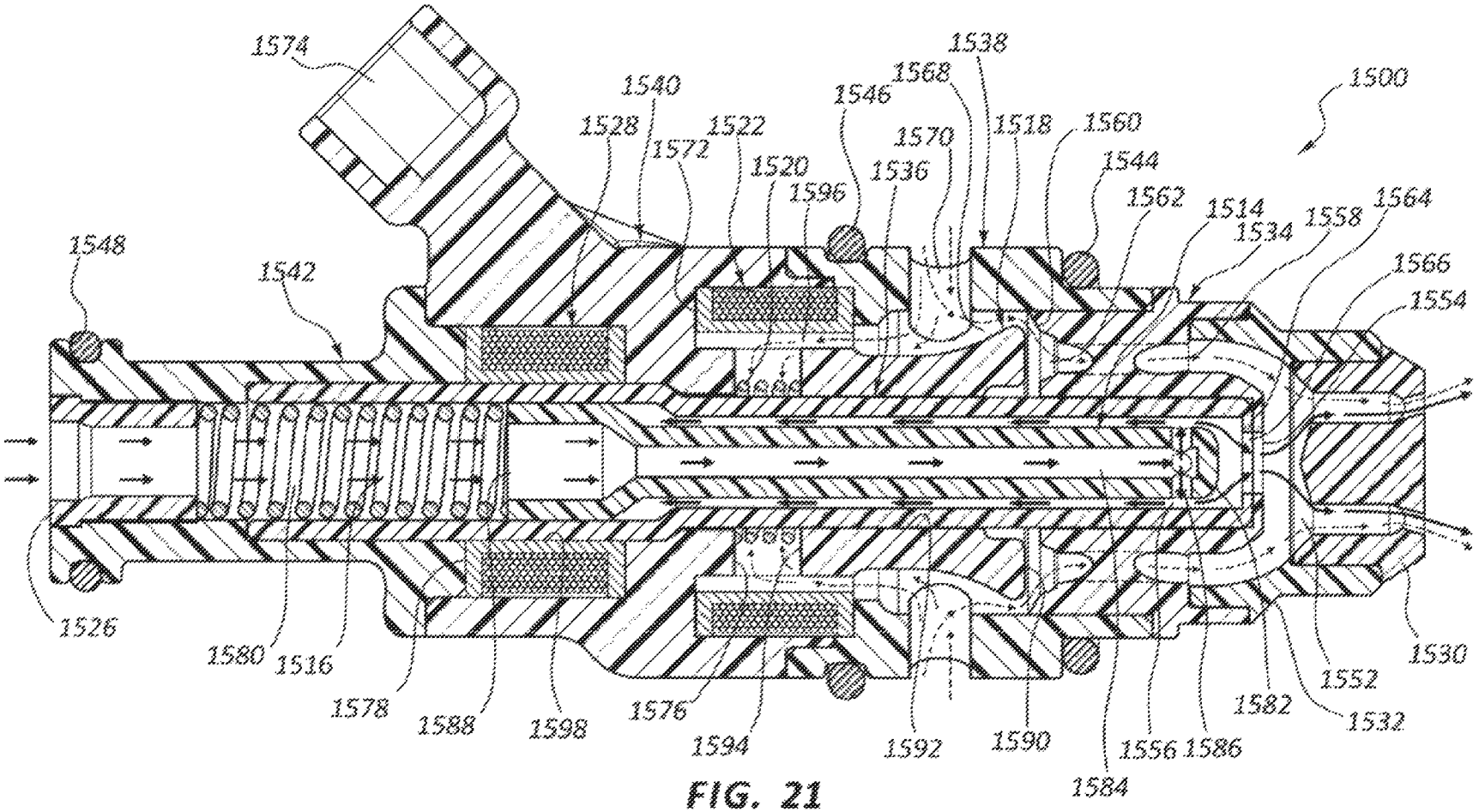
FIG. 21 is a cross-sectional view of the fuel delivery device of FIG. 18 taken along cross-section indicators 21-21.

FIG. 21 shows the air plunger 1518 moved axially away from the upper mix housing 1534 such that the distal sealing surface 1590 of the air plunger 1518 is spaced apart from the air sealing seat 1560 to permit exposure of the air aperture 1562 to the supply of equalized pressure air. The air aperture 1562, when exposed to the pressurized air in the air cavity 1568, provides a flow path for air to travel into the mixing chamber 1552. The air channel 1558 may be angled circumferentially moving from the air aperture 1562 to the mixing chamber 1552. In at least some arrangements, the air channel 1558 may be angled radially inward or radially outward from the air aperture 1562 to the mixing chamber 1552. The air channels 1558 may be angled in both circumferential and radial directions.

The air plunger 1518 may be advanced axially to contact the distal sealing surface 1590 against the air sealing seat 1560. This orientation of the air plunger 1518 seals the air aperture 1562 from the source of equalized pressure air held in the air cavity 1568.

The air inlet 1570 in the air housing 1538 may be equally spaced apart around a periphery of the air housing 1538. Typically, the air inlets 1570 are arranged in pairs at about 180° spacing around the periphery of the air housing 1538. The number of air inlets 1570 is typically an even number. However, different numbers and arrangements are possible for the air inlet 1570 in other embodiments.

An example fuel delivery sequence or fueling event may be described with reference to the fuel delivery device 1500 of FIGS. 18-21. The fuel plunger 1514 and air plunger 1518 may initially be positioned in closed positions. The fuel spring 1516 applies a biasing force to the fuel plunger 1514 that holds the distal sealing surface 1582 against the plunger seat 1564 to prevent fluid flow into the mixing chamber 1552. The air spring 1520 applies a biasing force to the air plunger 1518 to hold the distal sealing surface 1590 against the air sealing seat 1560, which prevents airflow into the mixing chamber 1552.

The fueling sequence is initiated by activating the first solenoid 1522, which generates a magnetic field that draws the air plunger 1518 rearward against biasing forces of the air spring 1520 to move the distal sealing surface 1590 away from the air sealing seat 1560. Air from the air cavity 1568 travels through the air channels 1558, into the mixing chamber 1552, and out of the delivery tip 1530. The air spring 1520 is at least partially compressed when the air plunger 1518 is retracted into the position.

A further step in the fueling sequence may include activating the second solenoid 1528, which creates a magnetic field that draws the fuel plunger 1514 axially in a rearward direction against biasing forces of the fuel spring 1516. Withdrawing the fuel plunger 1514 moves the distal sealing surface 1582 away from the plunger seat 1564 to permit fuel to flow from the fuel cavity 1556, through the fuel aperture 1566 and fuel aperture 1554, and into the mixing chamber 1552 to mix with the airflow. The fuel and air mix within the mixing chamber 1552 and are delivered out of the delivery tip 1530 as shown in FIG. 21. The air/fuel mixture is delivered to a combustion chamber of the IC engine for combustion. The air/fuel mixture may travel through an intermediate structure such as an intake port before entry into the combustion chamber.

The second solenoid 1528 is then deactivated to eliminate the magnetic field acting upon the fuel plunger 1514. With the magnetic field removed, the fuel spring 1516 applies its biasing force to the fuel plunger 1514 to begin advancing the distal sealing surface 1582 toward contact with the plunger seat 1564 to stop fuel flow into the mixing chamber 1552.

The airflow is stopped by deactivating the first solenoid 1522, which eliminates the magnetic field acting on air plunger 1518 and permits the air spring 1520 to advance the distal sealing surface 1590 of the air plunger 1518 into contact with the air sealing seat 1560. As discussed above, the delay between closing the fuel plunger 1514 and closing the air plunger 1518 permits the air flow to clear out fuel within the mixing chamber 1552 and delivery tip 1530. The equalized flow of air through the fuel delivery device 1500 provided by the co-axial arrangement of air and fuel material features may provide improved clear out of fuel within the mixing chamber 1552 and delivery tip 1530.

There may be a number of advantages related to the systems and methods described herein as compared to existing technologies. One advantage may relate to providing an advance control strategy configured to detect air supply conditions and shut down operation of the engine to protect from catastrophic engine failure due to power cylinder fuel wetting or drenching. Another possible advantage is providing multiple sources of air supply to mitigate engine shutdown and a "walk home" failure mode in which the engine is inoperable for failure to provide adequate fuel supply. A further advantage may relate to providing a control strategy that enables a "key on" engine start by automatically switching air supply sources without the operator intervening and continuing the recharge and start sequences until the engine starts, a shut down command is given, or the operator manually ends the sequence. Another advantage may relate to providing a "limp home" mode that continues operation of the fuel delivery device, and thus engine operation, in the event of a compressor failure. Some example limp home aspect of the present disclosure are discussed above.

The preceding description has been presented only to illustrate and describe certain aspects, embodiments, and examples of the principles claimed below. It is not intended to be exhaustive or to limit the described principles to any precise form disclosed. Many modifications and variations are possible in light of the above disclosure. Such modifications are contemplated by the inventor and within the scope of the claims. The scope of the principles described is defined by the following claims.

What is claimed is:

1. A method of controlling fluid delivery, comprising:
   - providing a fluid atomizer, a mechanically driven air compressor and an air source;
   - charging the air source with a volume of compressed air independent of the mechanically driven air compressor;
   - delivering compressed air from the start up air source to the fluid atomizer;
   - after delivering compressed air from the air source, delivering compressed air from the mechanically driven air compressor to the fluid atomizer.

2. The method of claim 1, wherein the air source comprises an electrically driven air compressor.

3. The method of claim 1, wherein the air source comprises an accumulator, and charging the air source including delivering compressed air from one of a cylinder of an engine prior to starting the engine during engine start cranking and an electrically driven air compressor to the accumulator.

4. The method of claim 1, wherein the air source includes a one-way valve and an accumulator, and charging the air source includes controlling, with the one-way valve, air flow from a cylinder of an engine that is not running during engine start cranking to the accumulator.

5. The method of claim 3, further comprising providing a scavenger valve into the cylinder and determining an engine position and cycle before opening the scavenger valve.

6. The method of claim 3, further comprising determining a pressure of the accumulator before delivering compressed air from the air source to the fluid atomizer.

7. The method of claim 2, wherein the air source comprises an accumulator, and charging the air source including delivering compressed air from the electrically driven air compressor to the accumulator.

8. The method of claim 1, further comprising operating the mechanically driven air compressor with a running engine.

9. The method of claim 1, further comprising confirming operation of the mechanically driven air compressor prior to delivering compressed air from the mechanically driven air compressor to the fluid atomizer.

10. A method of controlling air flow to a fluid atomizer, comprising:

providing a scavenger valve, the scavenger valve being coupled in flow communication with a cylinder of an engine;

opening the scavenger valve to collect compressed air during engine start cranking prior to starting the engine;

delivering the compressed air from the scavenger valve to the fluid atomizer, the fluid atomizer operable to create an air/fuel mixture.

11. The method according to claim 10, further comprising providing a mechanically driven air compressor and delivering compressed air from the mechanically driven air compressor to the fuel atomizer after the engine is running.

12. The method according to claim 11, further comprising providing an air control valve coupled between the mechanically driven air compressor, the scavenger valve, and the fluid atomizer, the method comprising operating the air control valve to direct compressed air from the mechanically driven air compressor to the fluid atomizer when the engine is running or from the scavenger valve to the fluid atomizer during engine start cranking when the engine is not running.

13. The method according to claim 10, further comprising providing an accumulator coupled in flow communication between the scavenger valve and the fluid atomizer, and a one-way valve between the accumulator and the scavenger valve to prevent backflow of compressed air into the cylinder.

14. The method according to claim 10, further comprising providing an accumulator coupled in flow communication between the scavenger valve and the fluid atomizer, and regulating pressure of the compressed air delivered to the fluid atomizer to a predetermined pressure level with the accumulator.

15. A method of starting an internal combustion engine, comprising:

providing a fuel delivery system and a compressed air source;

charging the compressed air source with compressed air from the engine prior to combusting fuel in the engine;

providing a flow of the compressed air from the compressed air source to the fuel delivery system;

creating a fuel/air mixture with the fuel delivery system;

delivering the fuel/air mixture to a cylinder of the engine to start the engine.

16. The method of claim 15, wherein the compressed air source comprises an accumulator, the method further comprising collecting the compressed air from the engine in the accumulator.

17. The method of claim 15, wherein the compressed air source comprises an accumulator and a scavenger valve, the scavenger valve being coupled to a cylinder of the engine, the method further comprising operating the scavenger valve to collect compressed air from the cylinder when turning over the engine and before starting the engine, and delivering the compressed air to the accumulator.

18. The method of claim 15, further comprising providing a mechanically operated air compressor, and operating the mechanically operated air compressor to generate compressed air for the fuel delivery system after the engine starts.

19. The method of claim 16, further comprising providing an electrically driven air compressor, and operating the electrically driven air compressor to charge the accumulator.

20. The method of claim 15, further comprising providing a controller and a plurality of sensors, wherein the controller initiates delivery of the fuel/air mixture to the engine after a threshold air pressure is available from the compressed air source as determined by the plurality of sensors.

* * * * *